US011071350B2

(12) United States Patent
Glancy et al.

(10) Patent No.: US 11,071,350 B2
(45) **Date of Patent: *Jul. 27, 2021**

(54) ARTICLE OF FOOTWEAR WITH MULTIPLE DUROMETER OUTSOLE

(71) Applicant: Under Armour, Inc., Baltimore, MD (US)

(72) Inventors: Michael Glancy, Baltimore, MD (US); Matthew Cougle, Baltimore, MD (US); Kris deGrano, Baltimore, MD (US); Ryan Olkowski, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/856,139

(22) Filed: Dec. 28, 2017

(65) Prior Publication Data

US 2018/0184758 A1 Jul. 5, 2018

Related U.S. Application Data

(60) Provisional application No. 62/441,187, filed on Dec. 31, 2016.

(51) Int. Cl.
*A43B 13/22* (2006.01)
*A43B 23/02* (2006.01)
(Continued)

(52) U.S. Cl.
CPC ..... *A43B 13/223* (2013.01); *A43B 5/00* (2013.01); *A43B 13/16* (2013.01); *A43B 13/22* (2013.01);
(Continued)

(58) Field of Classification Search
CPC ..... A43B 13/12; A43B 13/14; A43B 13/16; A43B 13/22; A43B 13/122; A43B 13/186;
(Continued)

(56) References Cited

U.S. PATENT DOCUMENTS 4,098,011 A * 7/1978 Bowerman ..... A43B 5/06 36/129
6,748,675 B2 * 6/2004 Sato ..... A43B 13/12 36/28
(Continued)

FOREIGN PATENT DOCUMENTS

MX 2015007118 A 3/2016

OTHER PUBLICATIONS

PCT International Search Report and the Written Opinion, PCT/US/2017/067903, dated May 31, 2018, 7 pages.

*Primary Examiner* — Sharon M Prange
*Assistant Examiner* — Grace Huang
(74) *Attorney, Agent, or Firm* — Edell, Shapiro & Finnan, LLC

(57) ABSTRACT

The present invention is directed toward an article of footwear having a sole structure effective to increase traction on a support surface. The article of footwear includes a sole structure comprising a first sole structure and a second sole structure. The article of footwear includes a forefoot region, midfoot region, and hindfoot region. The first sole structure is disposed in the forefoot and hindfoot regions. The second sole structure is disposed in the midfoot region. An extension of the second sole structure that extends through the forefoot region is substantially covered by the first sole structure. A plurality of lugs extend downwardly from the bottom surface of the first sole structure. At least one lug extends downwardly from the extension of the second sole structure through the first sole structure. The first sole structure and the second sole structure have different durometers.

5 Claims, 15 Drawing Sheets

(51) Int. Cl.

| | |
|---|---|
| ***A43B 13/16*** | (2006.01) |
| ***A43C 15/16*** | (2006.01) |
| ***A43B 5/02*** | (2006.01) |
| ***A43B 5/00*** | (2006.01) |
| *A43B 7/14* | (2006.01) |
| *A43B 13/12* | (2006.01) |

(52) U.S. Cl.
CPC ..... *A43B 23/028* (2013.01); *A43C 15/162* (2013.01); *A43B 5/02* (2013.01); *A43B 7/1425* (2013.01); *A43B 7/1435* (2013.01); *A43B 7/1445* (2013.01); *A43B 13/12* (2013.01)

(58) Field of Classification Search
CPC ..... A43B 13/188; A43B 13/223; A43B 5/00; A43B 5/02; A43B 23/02; A43B 23/028; A43B 7/1425; A43B 7/1435; A43B 7/1445; A43B 23/021; A43B 23/0215; A43C 15/16; A43C 15/162; A43C 15/165; A43C 15/167; A43C 15/168
USPC ..... 36/103
See application file for complete search history.

(56) References Cited

U.S. PATENT DOCUMENTS 6,948,264 B1 * 9/2005 Lyden ..... A43B 5/02 36/134
6,973,746 B2 * 12/2005 Auger ..... A43B 1/0072 36/128
8,286,371 B2 * 10/2012 Baker ..... A43C 15/168 36/128
8,776,397 B2 * 7/2014 Borel ..... A43B 13/026 36/103
8,931,187 B2 * 1/2015 Healy ..... A43B 13/122 36/30 R
9,032,645 B2 * 5/2015 Stauffer ..... A43C 15/00 36/67 R
9,210,967 B2 * 12/2015 Gerber ..... A43B 5/02
10,178,891 B2 * 1/2019 Christensen ..... A43B 3/0057
10,251,446 B2 * 4/2019 Bischoff ..... A43B 13/188
2011/0192056 A1 * 8/2011 Geser ..... A43B 13/26 36/114
2012/0055046 A1 * 3/2012 Baucom ..... A41D 13/065 36/103
2014/0150297 A1 * 6/2014 Holmes ..... A43B 13/125 36/103
2014/0259779 A1 * 9/2014 Hashish ..... A43B 3/246 36/100
2015/0075033 A1 3/2015 Cross et al.
2015/0313312 A1 * 11/2015 Park ..... A43B 13/122 36/31
2016/0227878 A1 8/2016 Lan
2016/0295958 A1 * 10/2016 Dyer ..... A43B 13/04
2018/0084862 A1 * 3/2018 Bacon ..... A43B 3/0052
2018/0185731 A1 * 7/2018 Glancy ..... A63B 69/3667
2018/0317591 A1 * 11/2018 Hollinger ..... A43B 1/0009

* cited by examiner

ARTICLE OF FOOTWEAR WITH MULTIPLE DUROMETER OUTSOLE

CROSS-REFERENCE TO RELATED APPLICATIONS

This application claims priority under 35 U.S.C. 119(e) to U.S. Provisional Patent Application Ser. No. 62/441,187, entitled "Article of Footwear with Multiple Durometer Outsole," filed Dec. 31, 2016, the disclosure of which is incorporated herein by reference in its entirety for all purposes.

FIELD OF THE INVENTION

The present invention relates to an article of footwear with a dual durometer outsole that increases traction.

BACKGROUND OF THE INVENTION

Typical and conventional cleats are not effective on artificial support surfaces (e.g., turf fields). Because of the design of turf fields, conventional cleats are not able to provide an adequate amount of traction on the artificial support surfaces, and thus, slow athletes down. The studs of the conventional cleats are not able to penetrate into and catch the ground of a turf field as they are on a natural field surface. As the number of sports fields designed and constructed as turf fields increases, shoes specifically designed for use on turf fields are required. The turf shoes must be configured to provide adequate amounts of traction for the turf fields to reduce and prevent the risk of injury.

Accordingly, it would be desirable to provide an article of footwear with a sole structure that is effective to provide increased traction on artificial surfaces and increase the speed at which movements are completed with the article of footwear.

SUMMARY OF THE INVENTION

The present invention is directed toward an article of footwear with a dual durometer sole structure. In an embodiment, the outsole may be constructed of a first sole portion that is compressible and a second sole portion that is incompressible. The first sole portion includes a plurality of compressible lugs, while the second sole portion includes a plurality of incompressible lugs. The first sole portion is primarily disposed in the forefoot and hindfoot regions of the article of footwear. The second sole portion is primarily disposed within the midfoot and hindfoot regions of the article of footwear. The second sole portion further includes an extension member that extends forward through the first sole portion disposed in the forefoot region. The compressible lugs may be disposed on the first sole portion in the forefoot and hindfoot regions. Conversely, the incompressible lugs are disposed the second sole portion disposed on the midfoot region and hindfoot region. In addition, incompressible lugs may descend from the extension member through the first sole structure. The extension member of the second sole structure may provide a spring back effect during the toe-off phase of a gait.

In addition, the compressible lugs are configured to compress when a force is imparted on the ends. The compressible lugs are further configured to bend. Thus, the compressible lugs enable better traction of the article of footwear by keeping the first outsole portion in contact with the ground/support surface for a longer amount of time through compression or bending (e.g., during various phases of a typical gait, shifting the weight of the user to different portions of the foot, etc.). In operation, the sole structure of the article of footwear is effective to increase the traction and increase the speed of movements performed with the article of footwear on an artificial surface.

In one embodiment, an article of footwear includes an upper, a first sole structure, and a second sole structure. The upper may define a cavity. The first sole structure may include a bottom surface and a top surface, where the top surface may be coupled to the upper. The first sole structure may further include a forefoot section, a hindfoot section, and a plurality of first lugs that extend from the bottom surface of the forefoot and hindfoot sections. The second sole structure may include a midfoot section that may be disposed between the forefoot section and the hindfoot section of the first sole structure. Furthermore, the second sole structure may contain at least one forward extension that extends forward from the midfoot section through the forefoot section of the first sole structure. The second sole structure may also contain at least one second lug disposed on the at least one forward extension. The at least one second lug may extend through the bottom surface of the forefoot section of the first sole structure.

In another embodiment, an article of footwear includes an upper, a first sole structure, and a second sole structure. The upper may define a cavity. The first sole structure may include a bottom surface and a top surface, where the top surface may be coupled to the upper. The first sole structure may further include a forefoot section and a hindfoot section. Furthermore, the first sole structure may be constructed to have a first durometer value, while the second sole structure may be constructed to have a second durometer value that is greater than the first durometer value. The second sole structure may further contain a midfoot section that may be disposed between the forefoot section and the hindfoot section of the first sole structure. The second sole structure may also contain a forward extension that extends from the midfoot section through the forefoot section of the first sole structure such that the forward extension extends between the upper and the bottom surface of the first sole structure. The forward extension may be configured to provide a spring back effect to the forefoot region of the first sole structure when the first sole structure is bent.

In yet another embodiment, an article of footwear includes an upper, a first sole structure, and a second sole structure. The upper may define a cavity. The first sole structure may include a bottom surface and a top surface, where the top surface may be coupled to the upper. The first sole structure may further include a forefoot section and a hindfoot section. Furthermore, the first sole structure may be constructed to have a first durometer value, while the second sole structure may be constructed to have a second durometer value that is greater than the first durometer value. The first sole structure may further contain a plurality of first lugs that are disposed on the bottom surface of the forefoot section and the hindfoot section. The second sole structure may be disposed between the forefoot section and the hindfoot section of the first sole structure, and may extend from an outermost lateral edge of the article of footwear to an outermost medial edge of the article of footwear. The second sole structure may include a plurality of second lugs extending from the second sole structure such that the plurality of second lugs extend beyond the bottom surface of the first sole structure.

BRIEF DESCRIPTION OF THE DRAWINGS

Like reference numerals have been used to identify like elements throughout this disclosure.

DETAILED DESCRIPTION OF THE INVENTION

Figure 1A:
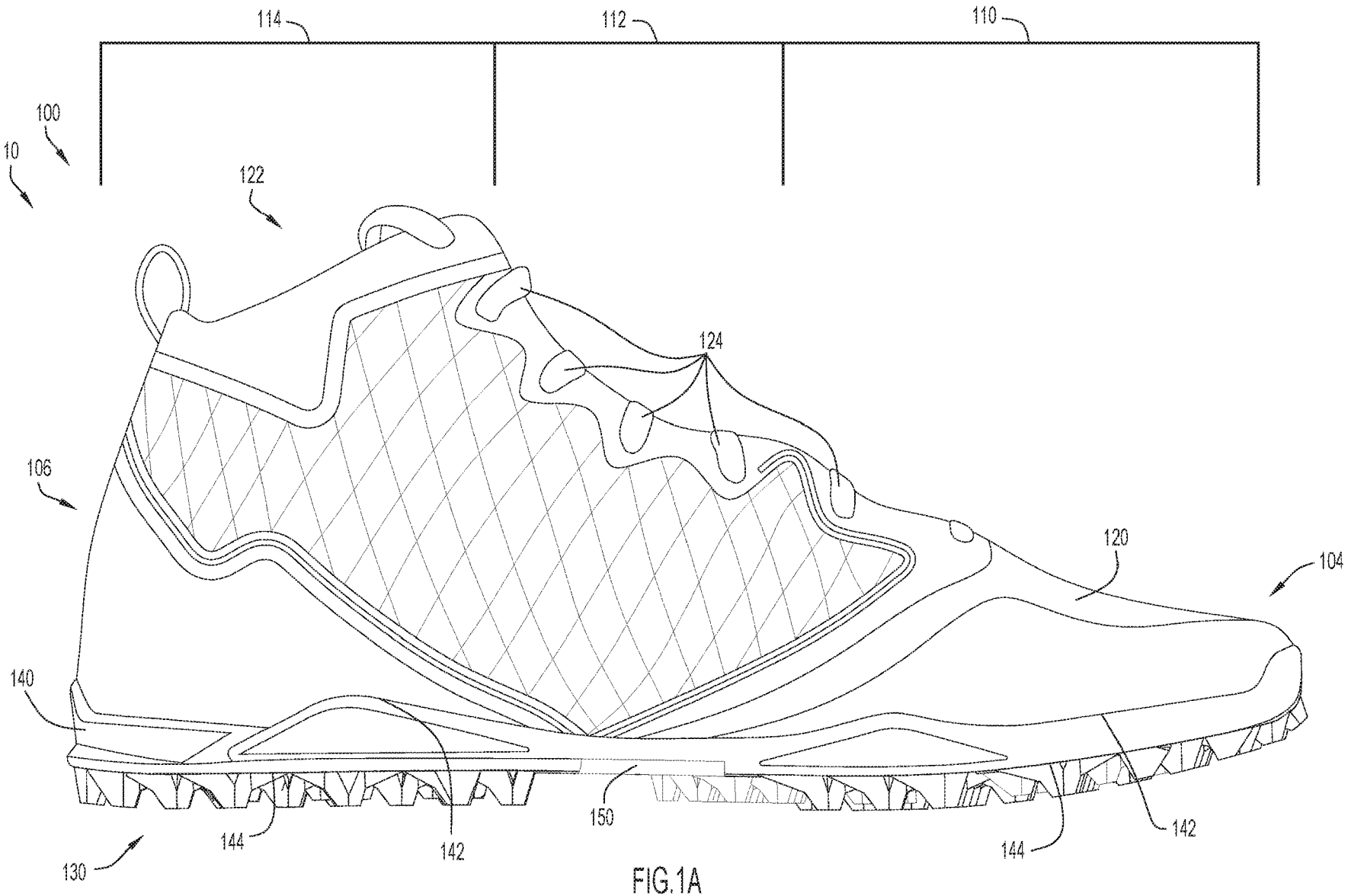
FIG. 1A illustrates a side elevational view of a medial side of an embodiment of an article of footwear according to the present invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

An article of footwear or shoe 10 includes a medial side 100 oriented along the medial or big toe side of the user's foot, a lateral side 102 oriented along the lateral or little toe side of the user's foot, a toe (i.e., front) end 104 that corresponds with the toes of the user's foot, and a heel (i.e., rear) end 106 that corresponds with the heel of the user's foot. While the example embodiment depicted in the FIGS. 1A, 1B, 2, 3A, 3B, 4A, 4B, 4C, 5, 6A, and 6B shows an article of footwear 10 configured for a left foot, it is noted that the same or similar features can also be provided for an article of footwear 10 configured for a right foot (where such features of the left footed article of footwear are a reflection or "mirror image" symmetrical in relation to a left footed article of footwear).

The article of footwear 10 may include a forefoot region 110 that generally aligns with the ball and toes of a user's foot (i.e., when a user is wearing the article of footwear 10), a midfoot region 112 that generally aligns with the arch and instep areas of the user's foot, and a hindfoot region 114 that generally aligns with the heel and ankle areas of the user's foot. The embodiment of the article of footwear 10 illustrated includes an upper 120 and a sole structure 130. The article of footwear 10 illustrated in FIGS. 1A, 1B, 2, 3A, 3B, 4A, 4B, 4C, 5, 6A, and 6B may be utilized in a turf shoe (i.e., a shoe designed for use on artificial turf surfaces) for lacrosse, football, baseball, or any other sport performed on an artificial turf surface. Other embodiments of the article of footwear 10 illustrated in FIGS. 1A, 1B, 2, 3A, 3B, 4A, 4B, 4C, 5, 6A, and 6B may be utilized and applied for use in any type of article of footwear, including, but not limited to, shoes, sneakers, boots, sandals, etc.

The upper 120 forms an envelope or pocket that, in cooperation with the sole structure 130, defines a foot cavity operable to house (cover and protect) the foot of the wearer of the article of footwear 10. The upper 120 may be constructed from various materials that are configured to conform and contour to a foot that is placed within the upper 120 of the article of footwear 10. In some embodiments, the various materials that may be used to construct the upper 120, include, but are not limited to, leather, synthetic leather, rubber, textile fabrics (e.g., breathable fabrics, mesh fabrics, synthetic fabrics), etc. One material used for the upper 120 may be configured to have a high degree of stretchability and compressibility, while another material used on the upper 120 may have a lower degree of stretchability and compressibility. The materials used on the upper 120 may be generally lightweight and flexible, and may be configured to provide comfort to the user and provide other desirable features. The materials used on the upper 120 may be configured to have desirable aesthetics and functional features that incorporate durability, flexibility, air permeability and/or other types of desirable properties to the upper 120. In one embodiment, the upper 120 may be formed of a high porosity material operable to permit the flow of fluid (e.g., air) therethrough. In another embodiment, the upper 120 may be formed of a low porosity material.

As further illustrated, a collar or opening 122 may be disposed in the hindfoot region 114 of the upper 120. The opening 122 provides access to the interior of the upper 120 and enables a foot of a wearer of the article of footwear 10 to be placed within the interior of the upper 120. In addition, a fastening element 124 may be threaded through the midfoot region 112 and at least a portion of the forefoot region 110 of the upper 120. The fastening element 124 may be utilized to secure or tighten the upper 120 around the foot disposed within the interior of the upper 120.

Figure 1B:
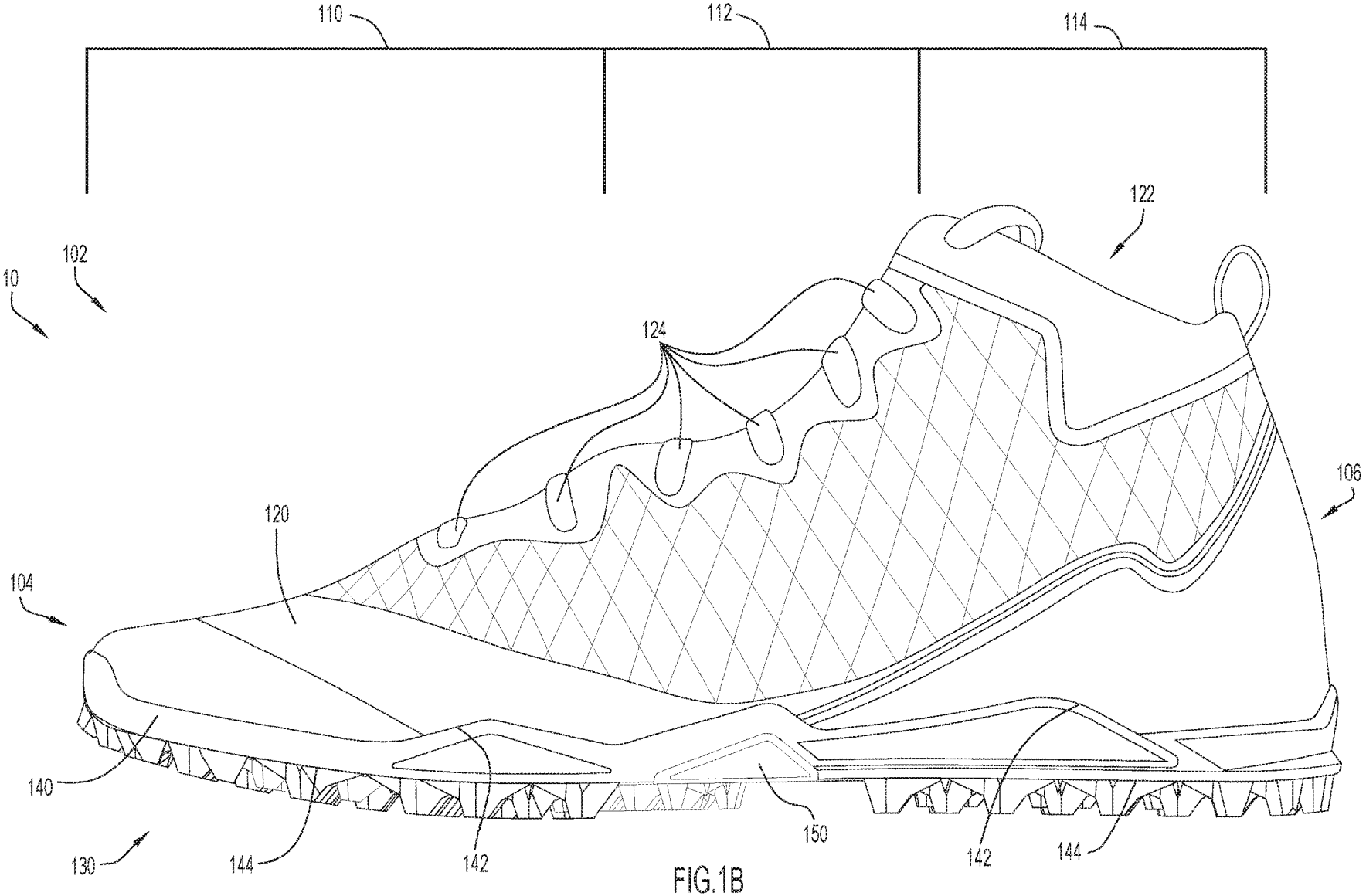
FIG. 1B illustrates a side elevational view of a lateral side of the embodiment of the article of footwear illustrated in FIG. 1A.

As further detailed below, the sole structure 130 includes a first sole portion 140 and a second sole portion 150. As illustrated in FIGS. 1A and 1B, the first sole portion 140 includes a top surface 142 and bottom surface 144, where the upper 120 may be disposed and directly coupled to the top surface 142 of the first sole portion 140. As further illustrated in FIG. 2, the first sole portion 140 includes a forefoot section 200 and a hindfoot section 210. The forefoot section 200 of the first sole portion 140 may be disposed primarily within the forefoot region 110 of the article of footwear 10, while the hindfoot section 210 of the first sole portion 140 may be disposed primarily within the hindfoot region 114 of the article of footwear 10.

Figure 2:
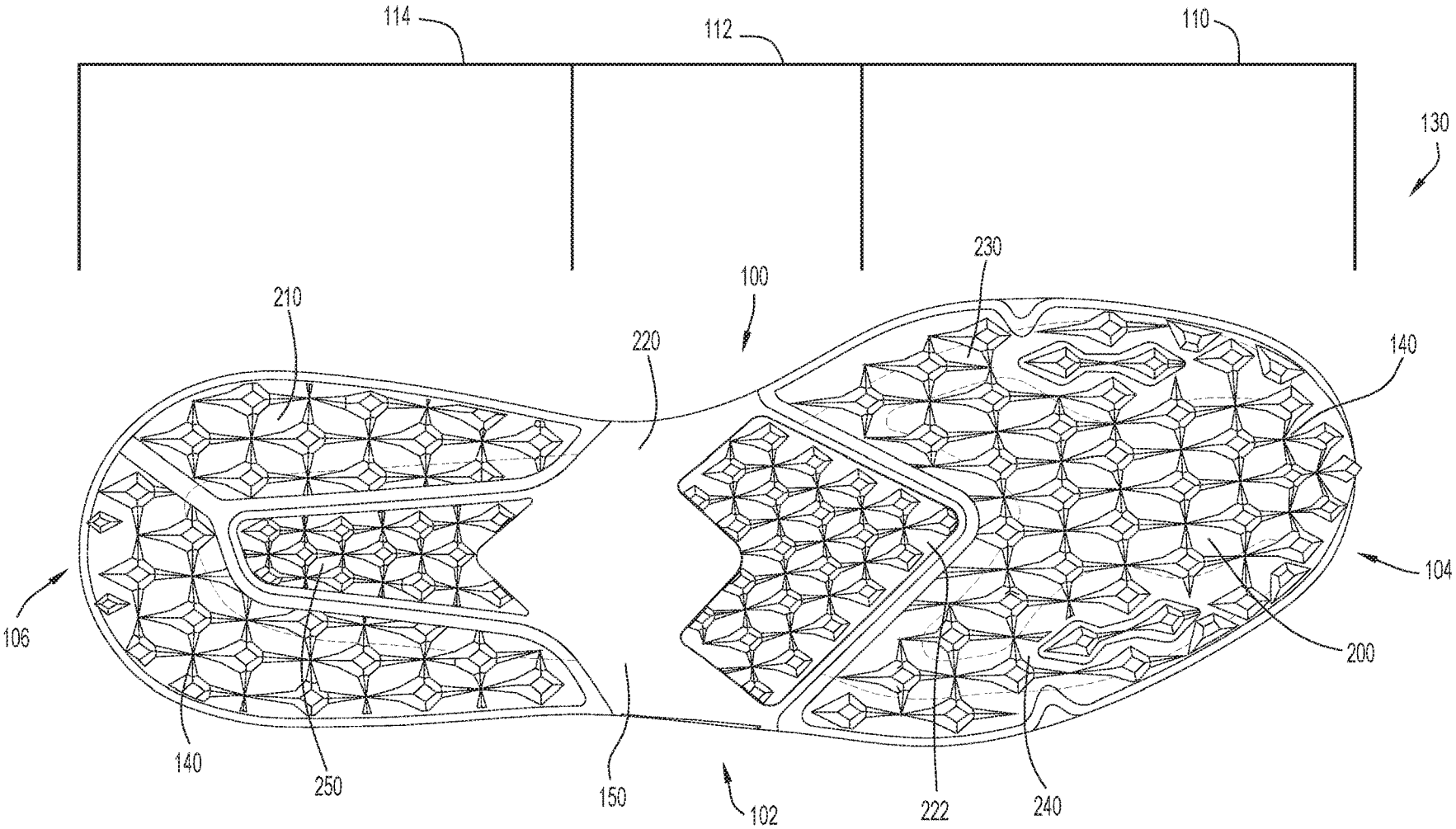
FIG. 2 illustrates a bottom view of the bottom surface of the sole structure of the embodiment of the article of footwear illustrated in FIG. 1A.

The second sole portion 150 includes a midfoot section 220, a medial side forward extension 230, a lateral side forward extension 240, and a rearward extension 250. The midfoot section 220 may be primarily disposed in the midfoot region 112 of the sole structure 130 of the article of footwear 10, with a projection 222 that extends towards the toe end 104 from the midfoot section 220 into the forefoot region 110 of the sole structure 130. As illustrated in FIG. 2, the midfoot section 220 of the second sole portion 150 divides the forefoot section 200 from the hindfoot section 210. The midfoot section 220 may be aligned with the arch of a foot disposed within the article of footwear 10.

As further detailed below, both the medial forward extension 230 and the lateral side forward extension 240 are coupled to the midfoot section 220 and extend forward towards the toe end 104 of the article of footwear 10. The medial forward extension 230 extends forward from the midfoot section 220 along the medial side 100 of the sole structure 130 of the article of footwear 10. Conversely, the lateral forward extension 240 extends forward from the midfoot section 220 along the lateral side 102 of the sole structure 130 of the article of footwear 10. As illustrated in FIG. 2, the medial forward extension 230 and the lateral forward extension 240 are primarily covered by the forefoot section 200 of the first sole portion 140.

The rearward extension 250 extends rearwardly from the midfoot section 220 toward the heel end 106 through the hindfoot region 114 of the sole structure 130 of the article of footwear 10. The rearward extension 250 may extend toward the heel end 106 substantially equidistant from the medial side 100 and the lateral side 102 of the article of footwear 10.

The first sole portion 140 may be constructed from a thermoplastic polyurethane (TPU) having a soft durometer. The second sole portion 150, as illustrated in FIG. 2, may be constructed from a TPU having a durometer that is higher or greater than the durometer of the first sole portion 140. Thus, the first sole portion 140 may be softer than the second sole portion 150, where the first sole portion 140 may have a higher degree of resiliency. In addition, the first sole portion 140 may have a durometer that enables the first sole portion 140 to be compressible, while the second sole portion 150 may be substantially incompressible compared to the first sole portion 140. In one example embodiment, the first sole portion 140 may have a durometer value (on a type A scale) in the range of 60-70 Shore A, while the second sole portion 150 may have a durometer value (on a type D scale) of approximately 72 Shore D. The term "durometer value," as used herein, refers to any standard or other suitable durometer measurement (e.g., a Shore A durometer hardness value, Shore C durometer hardness value, Shore D hardness value, etc.) that provides an indication of hardness, where lower durometer values indicates a softer material and higher durometer values indicates a harder material. The first sole portion 140 may further have a degree of translucency (i.e., the first sole portion 140 may be substantially clear). Furthermore, the second sole portion 150 may be opaque, and thus less translucent than the first sole portion 140.

Figure 3A:
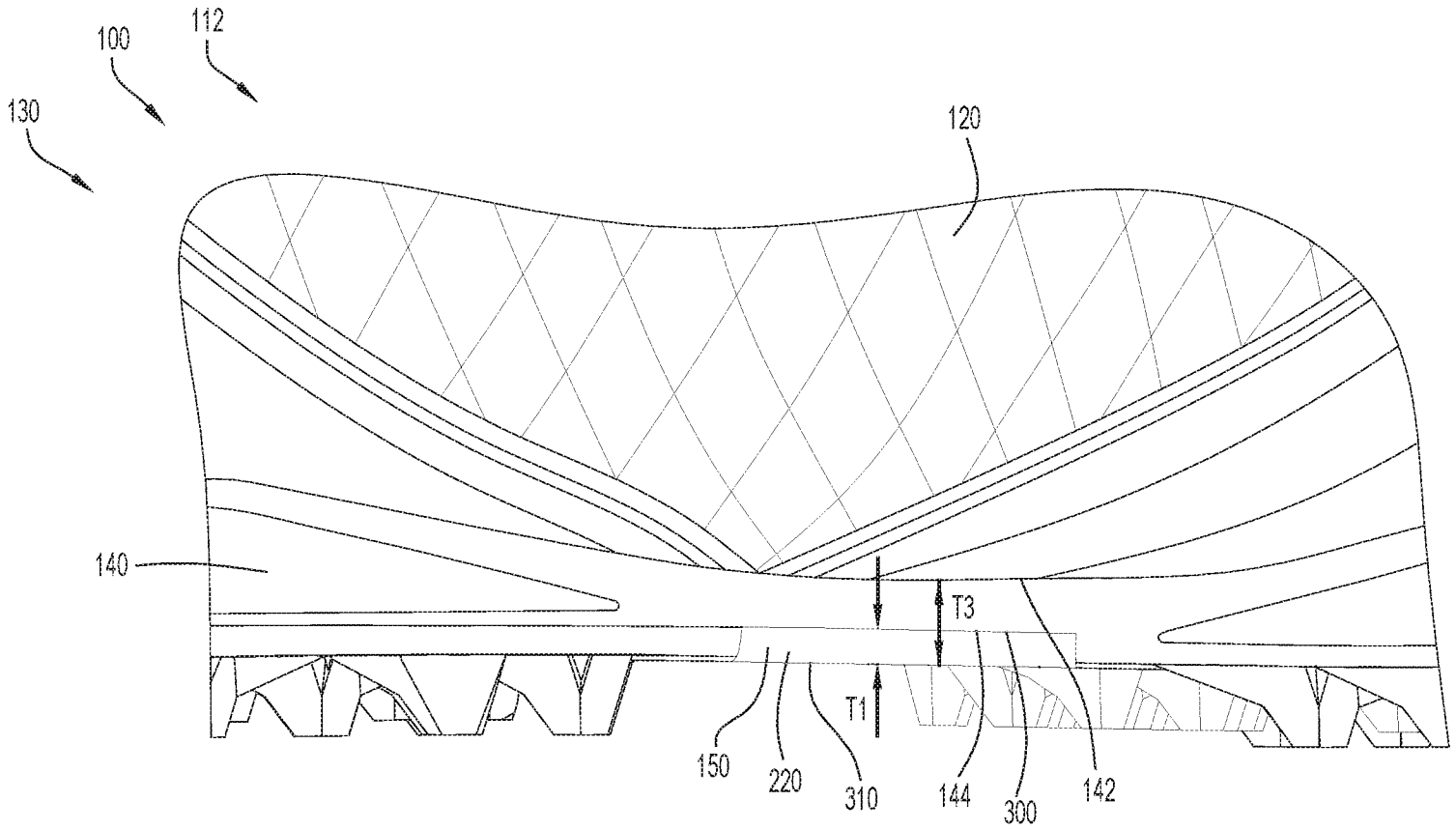
FIG. 3A illustrates a side elevational view of the medial side of the midfoot portion of the sole structure illustrated in FIG. 2.
Figure 3B:
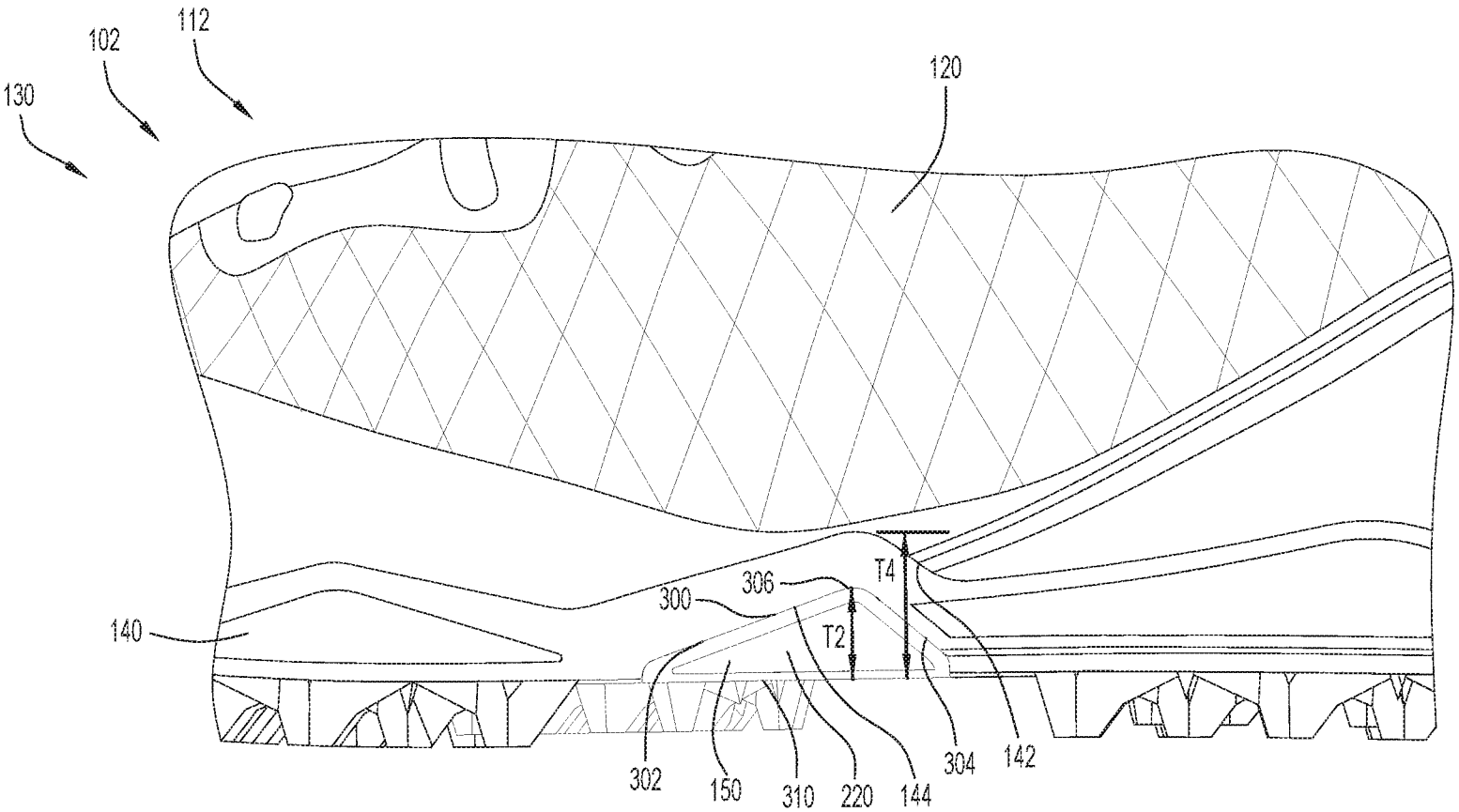
FIG. 3B illustrates a side elevational view of the lateral side of the midfoot portion of the sole structure illustrated in FIG. 2.

As illustrated in FIGS. 3A and 3B, the sole structure 130 is thicker on the lateral side 102 of the article of footwear 10 than on the medial side 100 of the article of footwear 10. The thickness of the sole structure 130 at the midfoot region 112 of the sole structure 130 may differ on the medial and lateral sides 100, 102 based on the thickness of the second sole portion 150, and more specifically, the thickness of the midfoot section 220 of the second sole portion 150. As previously described herein, the first sole portion 140 includes a top surface 142 and a bottom surface 144, where the upper 120 is coupled to the top surface 142 of the first sole portion 140. As further illustrated in FIGS. 3A and 3B, the second sole portion 150 includes a top surface 300 and a bottom surface 310, where, in at least the midfoot region 112 of the sole structure 130, the top surface 300 of the second sole portion 150 is coupled to the bottom surface 144 of the first sole portion 140. The top surface 300 of the midfoot section 220 of the second sole portion 150 may be parallel to the bottom surface 310 of the midfoot section 220 of the second sole portion 150 on the medial side 100 of the article of footwear 10. However, on the lateral side 102 of the article of footwear, the top surface 300 of the midfoot section 220 of the second sole portion 150 may not be parallel to the bottom surface 310 of the midfoot section 220 of the second sole portion 150. More specifically, on the lateral side 102 of the article of footwear 10, the top surface 300 of the midfoot section 220 includes a first sloped upper surface 302 and a second sloped upper surface 304, where the first and second sloped upper surfaces 302, 304 extend upward from the bottom surface 310 towards one another until uppermost point 306. In one embodiment, the first and second sloped upper surfaces 302, 304 may be of different lengths, which offsets the uppermost point 306 of the upper surface 300 from the center of the portion of the midfoot section 220 that is exposed on the lateral side 102 of the article of footwear 10.

The thickness of the midfoot section 220 of the second sole portion 150 is defined as the distance between the top surface 300 of the second sole portion 150 and the bottom surface 310 of the second sole portion 150. Furthermore, the thickness of the sole structure 130 in the midfoot region 112 of the article of footwear 10 is defined as the distance between the top surface 142 of the first sole portion 140 and the bottom surface 310 of the second sole structure 150. As illustrated in FIGS. 3A and 3B, the medial side thickness T1 of the midfoot section 220 of the second sole portion 150 is less than the lateral side thickness T2 of the midfoot section 220 of the second sole portion 150. While the lateral side thickness T2 varies because of the first and second sloped upper surfaces 302, 304, the lateral side thickness T2 is thickest at the uppermost point 306. It then follows that the medial side thickness T3 of the sole structure 130 is less than the lateral side thickness T4 of the sole structure 130. Thus, more of the sole structure 130 is disposed on the lateral side 102 of the article of footwear 10 in the midfoot region 112 when compared to the medial side 100 of the article of footwear 10 in the midfoot region 112. By positioning or orienting more of the second sole portion 150 on the lateral side 102 of the article of footwear 10 (i.e., the thicker T2 portion of the midfoot section 220; the thicker T4 portion of the sole structure 130) than on the medial side 100 of the article of footwear 10 (i.e., the less thick T1 portion of the midfoot section 220; the thinner T3 portion of the sole structure 130), the sole structure 130 is able to provide support to the arch portion of a foot disposed within the article of footwear 10 while still enabling the medial side of the arch of the foot to flex. The arch of the foot disposed in the article of footwear 10 is more able to flex during movements (i.e., running, walking, jumping, etc.) on the medial side of the foot than the lateral side of the foot because the medial side of the arch is less inhibited from flexing by the reduced portion (i.e., thinner portion T3 of the sole structure 130) of the sole structure 130 on the medial side 100 of the article of footwear 10.

Figure 4A:
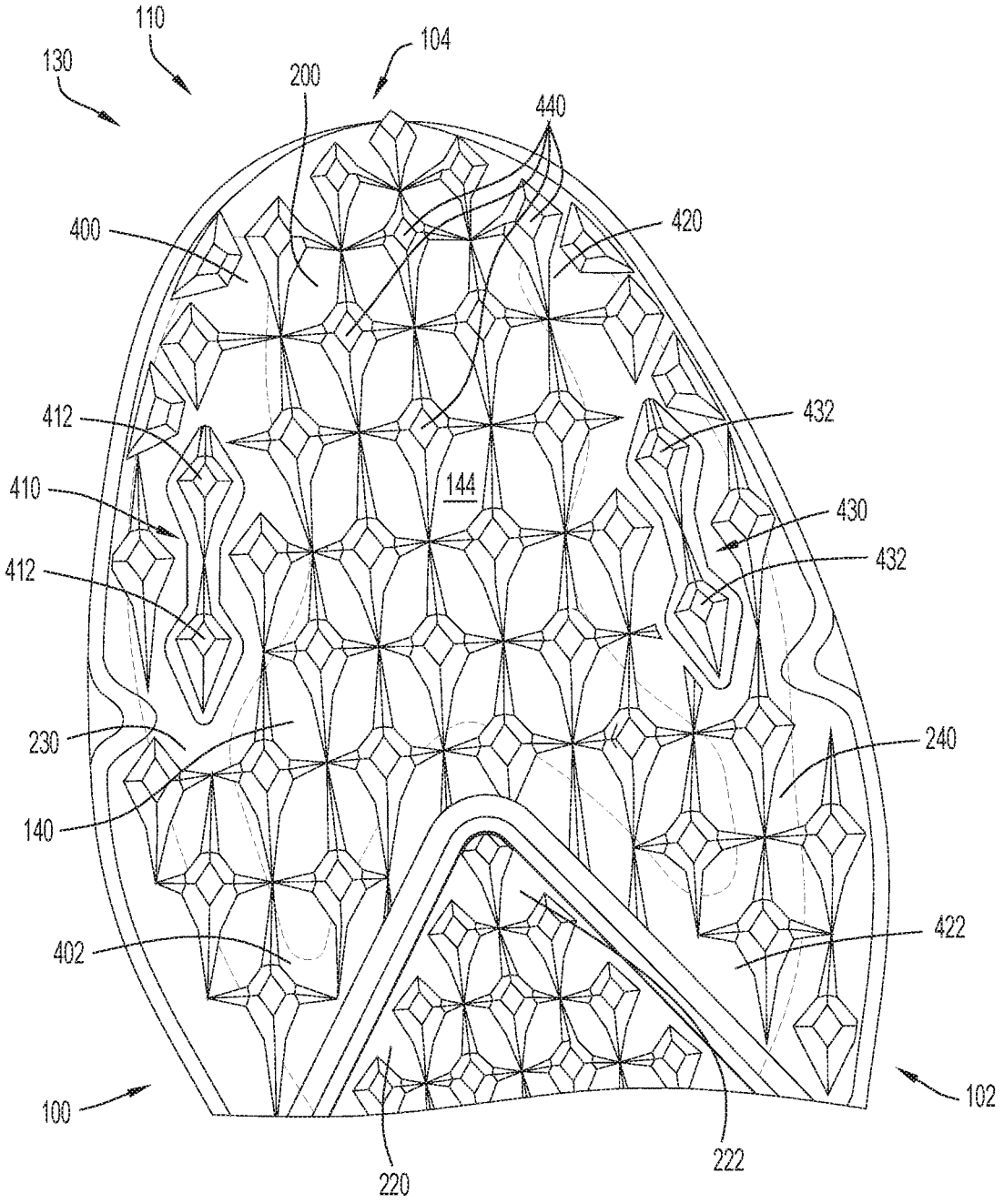
FIG. 4A illustrates a bottom view of the forefoot region of the sole structure illustrated in FIG. 2.
Figure 4B:
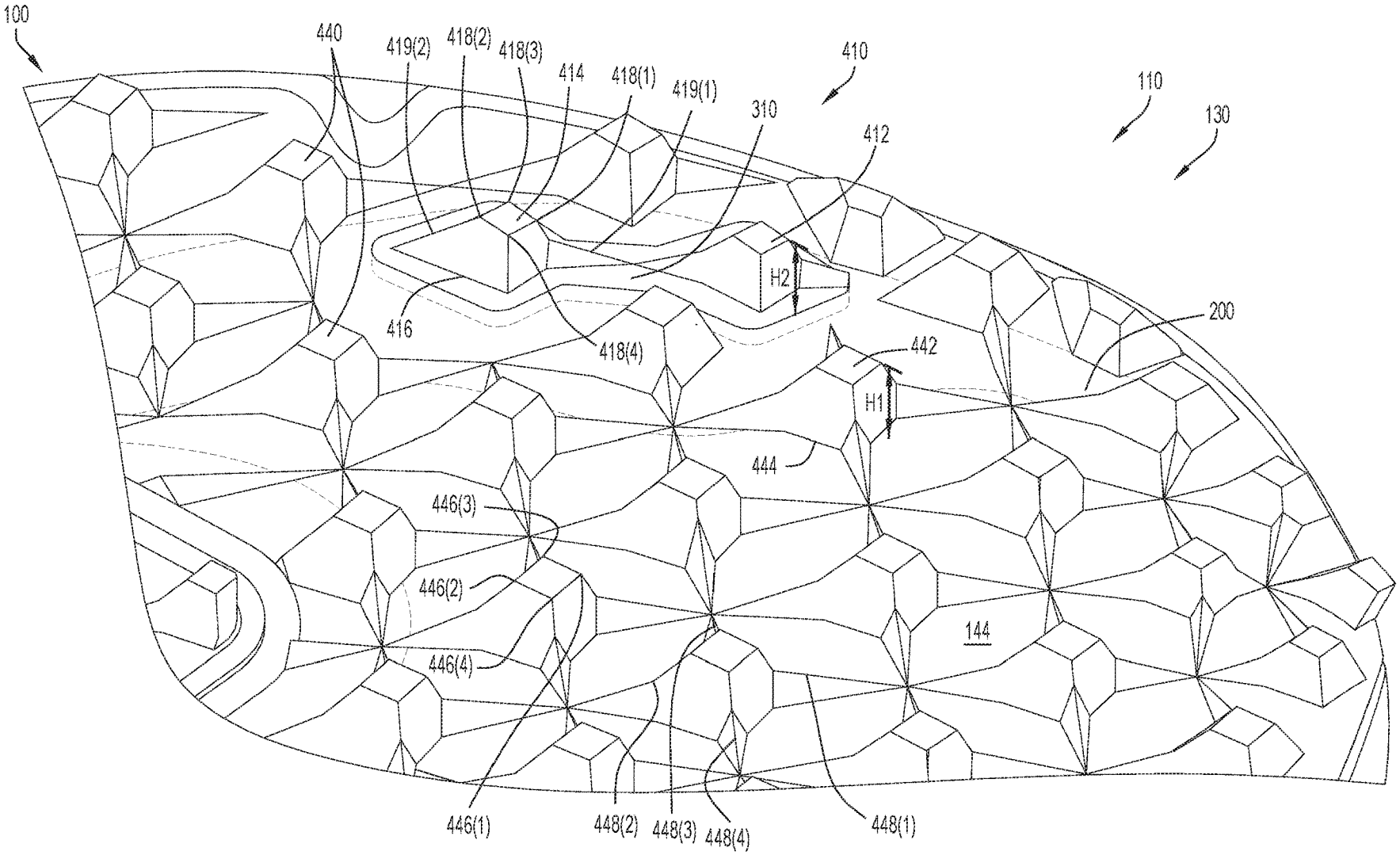
FIG. 4B illustrates a perspective view of the medial side of the forefoot region of the sole structure illustrated in FIG. 4A.

As previously described herein, the forefoot region 110 of the sole structure 130 is constructed from the forefoot section 200 of the first sole portion 140, the medial forward extension 230 of the second sole portion 150, the lateral forward extension 240 of the second sole portion 150, and a portion of the projection 222 of the midfoot section 220 of the second sole portion 150. As best illustrated in FIGS. 4A and 4B, the medial forward extension 230 includes a distal end 400 and a proximal end 402, where the proximal end 402 is coupled to the projection 222 of the midfoot section 220 of the second sole portion 150. The distal end 400 of the medial forward extension 230 is disposed proximate to the toe end 104 of the sole structure 130. As illustrated in FIGS. 4A and 4B, the medial forward extension 230 extends forward from the midfoot section 220 into and through a portion of the forefoot region 110 at a location that is above the bottom surface 144 of the forefoot section 200 of the first sole portion 140. Thus, as illustrated, the medial forward extension 230 is primarily covered by the bottom surface 144 of the forefoot section 200 of the first sole portion 140. The medial forward extension 230, however, includes a medial exposed portion 410 that extends downwardly from the medial forward extension 230 through the bottom surface 144 of the forefoot section 200 of the first sole portion 140. The medial exposed portion 410 is formed as part of the medial forward extension 230 and is located between the distal end 400 and the proximal end 402 of the medial forward extension 230 on the medial side 100 of the sole structure 130. As further illustrated in FIGS. 4A and 4B, the medial exposed portion 410 includes a pair of first lugs 412.

Figure 4C:
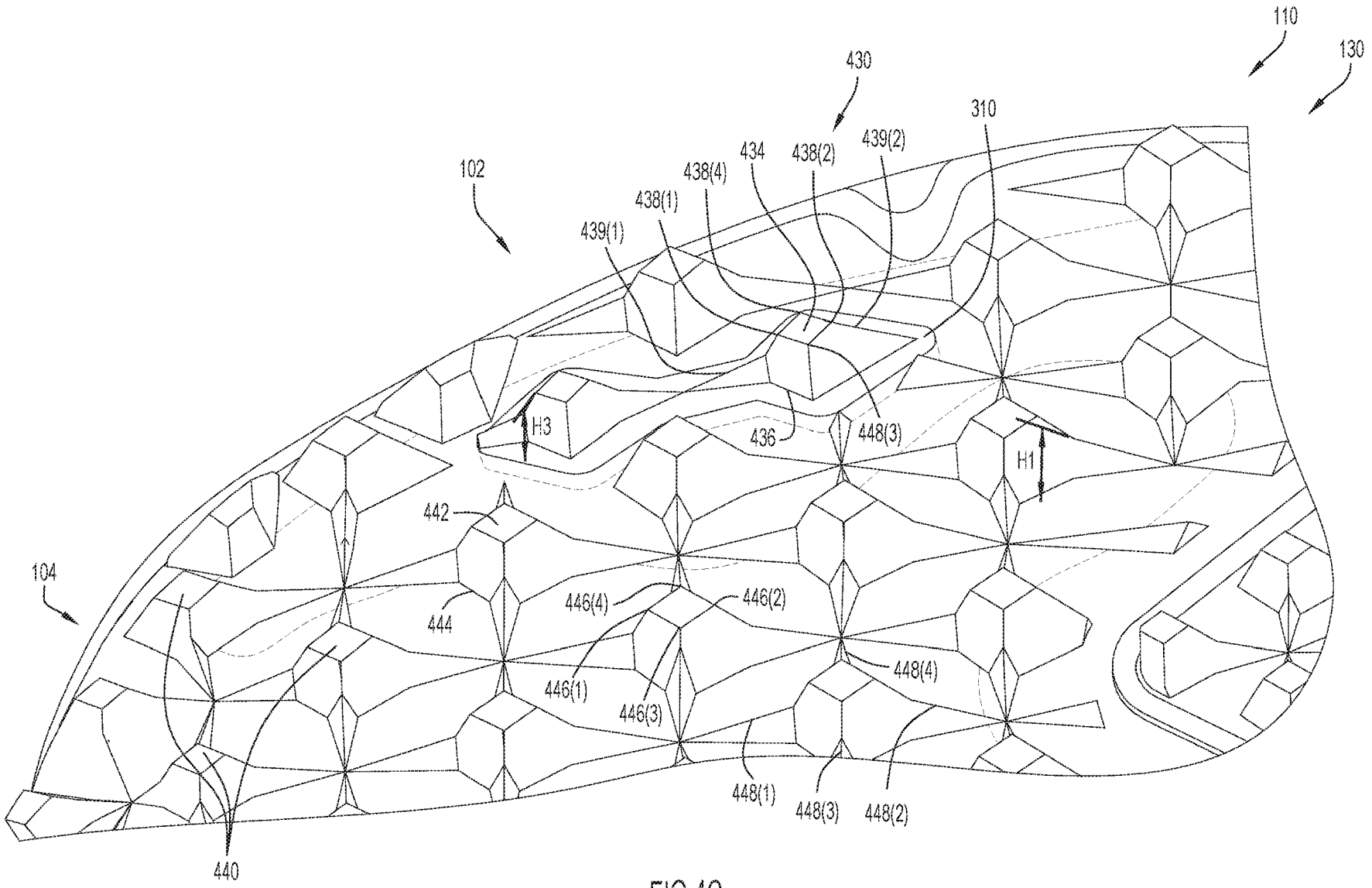
FIG. 4C illustrates a perspective view of the lateral side of the forefoot region of the sole structure illustrated in FIG. 4A.

Similar to the medial forward extension 230, and as best illustrated in FIGS. 4A and 4C, the lateral forward extension 240 includes a distal end 420 and a proximal end 422, where the proximal end 422 is coupled to the projection 222 of the midfoot section 220 of the second sole portion 150. The distal end 420 of the lateral forward extension 240 is disposed proximate to the toe end 104 of the sole structure 130 and proximate to the lateral side 102 of the sole structure 130. As illustrated in FIGS. 4A and 4C and similar to the medial forward extension 230, the lateral forward extension 240 extends forward from the midfoot section 220 through the forefoot region 110 above the bottom surface 144 of the forefoot section 200 of the first sole portion 140. Thus, the lateral forward extension 240 is primarily covered by the bottom surface 144 of the forefoot section 200 of the first sole portion 140. Similar to the medial forward extension 230, the lateral forward extension 240 also includes a lateral exposed portion 430 that extends downwardly from the lateral forward extension 240 through the bottom surface 144 of the forefoot section 200 of the first sole portion 140. The lateral exposed portion 430 is formed as part of the lateral forward extension 240 and is located between the distal end 420 and the proximal end 422 of the lateral forward extension 240 on the lateral side 102 of the sole structure 130, and may laterally align with the medial exposed portion 410. As further illustrated in FIGS. 4A and 4C, the lateral exposed portion 430 also includes a pair of second lugs 432. The first lugs 412 and the second lugs 432 may be substantially equivalent in size and shape.

As further illustrated in FIGS. 4A, 4B, and 4C, the forefoot section 200 includes a plurality of lugs 440 that extend downwardly from the bottom surface 144 of the forefoot section 200 of the first sole portion 140. The plurality of lugs 440 may be disposed throughout the bottom surface 144 of the forefoot section 200 in a grid-like array, where the plurality of lugs 440 are equally spaced from one another. While the lugs 440 may be in the form of any shape, each of the plurality of lugs 440 illustrated in FIGS. 4B and 4C are in the form of a truncated cone or truncated pyramid. In the embodiment illustrated, each of the plurality of lugs 440 includes a top end 442 and a bottom end 444, where the bottom end 444 is coupled to the bottom surface 144 of the forefoot section 200 of the first sole portion 140. The top ends 442 of the plurality of lugs 440 may be configured to contact and impact a support surface. Each of the plurality of lugs 440 may have a height H1, which is defined as the distance between the top end 442 and the bottom end 444 of the lug 440. In other words, the height H1 may be the distance the lugs 440 extend from the bottom surface 144 of the forefoot section 200 of the first sole portion 140.

Furthermore, each of the plurality of lugs 440 includes a front or leading corner 446(1), a rear or trailing corner 446(2), a medial corner 446(3), and a lateral corner 446(4). Each of the plurality of lugs 440 also includes a series of flanges 448(1)-448(4) extending from each corner 446(1)-446(4) of the lugs 440 toward the bottom surface 144. Thus, as illustrated, the front or leading flange 448(1) extends from the front or leading corner 446(1), the rear or trailing flange 448(2) extends from the rear or trailing corner 446(2), the medial flange 448(3) extends from the medial corner 446(3), and the lateral flange 448(4) extends from the lateral corner 446(4). The leading flange 448(1), medial flange 448(3), and lateral flange 448(4) may be coupled to the leading corner 446(1), medial corner 446(3), and lateral corner 448(4), respectively, at a location between the top end 442 and the bottom end 444 such that the leading flange 448(1), medial flange 448(3), and lateral flange 448(4) extend towards the bottom surface 144. The trailing flange 448(2) may be coupled to the trailing corner 446(2) at the top end 442 such that the trailing flange 448(2) extends towards the bottom surface 144. As illustrated, the trailing flange 448(2) of each of the lugs 440 may be longer in length than the leading flange 448(1), medial flange 448(3), and lateral flange 448(4).

As further illustrated in FIGS. 4A and 4B, the first lugs 412 of the medial exposed portion 410 are substantially similar in shape to the plurality of lugs 440 of the forefoot section 200. As previously described herein, the first lugs 412 of the medial exposed portion 410 extend downwardly from the bottom surface 310 of the medial forward extension 230 of the second sole portion 150 through the bottom surface 144 of the forefoot section 200. In addition, the first lugs 412 are disposed in the forefoot region 110 of the sole structure 130 proximate to the medial side 100 of the article of footwear 10. Similar to the plurality of lugs 440, each of the first lugs 412 may be in the form of a truncated cone or truncated pyramid. While illustrated as a truncated pyramid, other embodiments of the first lugs 412 may be of any other shape. As best illustrated in FIG. 4B, however, each of the first lugs 412 includes a top end 414 and a bottom end 416, where the bottom end 416 is coupled to the bottom surface 310 of the medial forward extension 230 of the second sole portion 150. The top ends 414 of the first lugs 412 may be configured to contact and impact a support surface like that of the top end 442 of the plurality of lugs 440. The first lugs 412 may have a height H2, which is defined as the distance between the top end 414 and the bottom end 416 of the lugs 412, or as the distance the lugs 412 extend beyond the bottom surface 144 of the forefoot section 200 of the first sole portion 140. As further detailed below, the height H2 may be smaller than the height H1 by approximately 1.0 mm. Thus, the first lugs 412 may be shorter than the lugs 440.

Additionally, each of the first lugs 412 includes a front or leading corner 418(1), a rear or trailing corner 418(2), a medial corner 418(3), and a lateral corner 418(4). The first lugs 412 also includes a front or leading flange 419(1) and a rear or trailing flange 419(2) that extend from the leading corner 418(1) and the trailing corner 418(2), respectively. As illustrated, the leading flange 419(1) may be coupled to the leading corner 418(1) at a location between the top end 414 and the bottom end 416 such that the leading flange 419(1) extends downwardly towards the bottom surface 144 in a manner substantially similar to that of the flanges 448(1), 448(3), 448(4) of the plurality of lugs 440. The trailing flange 419(2) may be coupled to the trailing corner 418(2) at the top end 414 such that the trailing flange 419(2) extends downwardly towards the bottom surface 310 in a manner that is substantially similar to that of the trailing flange 448(2) of the plurality of lugs 440. Furthermore, similar to the trailing flange 448(2) of the plurality of lugs 440, the trailing flange 419(2) may be longer in length than the leading flange 419(1).

The second lugs 432 of the lateral exposed portion 430 are substantially similar in shape to the first lugs 412 of the medial exposed portion 410. Similar to the first lugs 412, the second lugs 432 of the lateral exposed portion 430 extend downwardly from the bottom surface 310 of the lateral forward extension 240 of the second sole portion 150 through the bottom surface 144 of the forefoot section 200. As previously described herein, the second lugs 432 are disposed in the forefoot region 110 of the sole structure 130 proximate to the lateral side 102 of the article of footwear 10. Similar to the first lugs 412, while the second lugs 432 may be formed in any shape, in the embodiment illustrated in FIGS. 4A and 4C, the second lugs 432 are shaped as a truncated cone or truncated pyramid. As best illustrated in FIG. 4C, each of the second lugs 432 includes a top end 434 and a bottom end 436, where the bottom end 436 is coupled to the bottom surface 310 of the lateral forward extension 240 of the second sole portion 150. The top ends 434 of the second lugs 432 may be configured to contact and impact a support surface like that of the top end 442 of the plurality of lugs 440 and the top end 414 of the first lugs 412. The second lugs 432 may have a height H3, which is substantially similar to the height H2 of the first lugs 412. The height H3 of the second lugs 432 is defined as the distance between the top end 434 and the bottom end 436, or as the distance the lugs 432 extend beyond the bottom surface 144 of the forefoot section 200 of the first sole portion 140.

Additionally, each of the second lugs 432 includes a front or leading corner 438(1), a rear or trailing corner 438(2), a medial corner 438(3), and a lateral corner 438(4). Similar to the first lugs 412, the second lugs 432 also include only a front or leading flange 439(1) and a rear or trailing flange 439(2) that extend from the leading corner 438(1) and the trailing corner 438(2), respectively. As illustrated, the leading flange 439(1) may be coupled to the leading corner 438(1) at a location between the top end 434 and the bottom end 436 such that the leading flange 439(1) extends towards the bottom surface 144 in a manner substantially similar to that of the flanges 419(1), 448(1), 448(3), 448(4) of the lugs 412, 440. The trailing flange 439(2) may be coupled to the trailing corner 438(2) at the top end 434 such that the trailing flange 439(2) extends towards the bottom surface 310 in a manner that is substantially similar to that of the trailing flanges 419(2), 448(2) of the lugs 412, 440, respectively. The trailing flange 439(2) may be longer in length than the leading flange 439(1).

Figure 5:
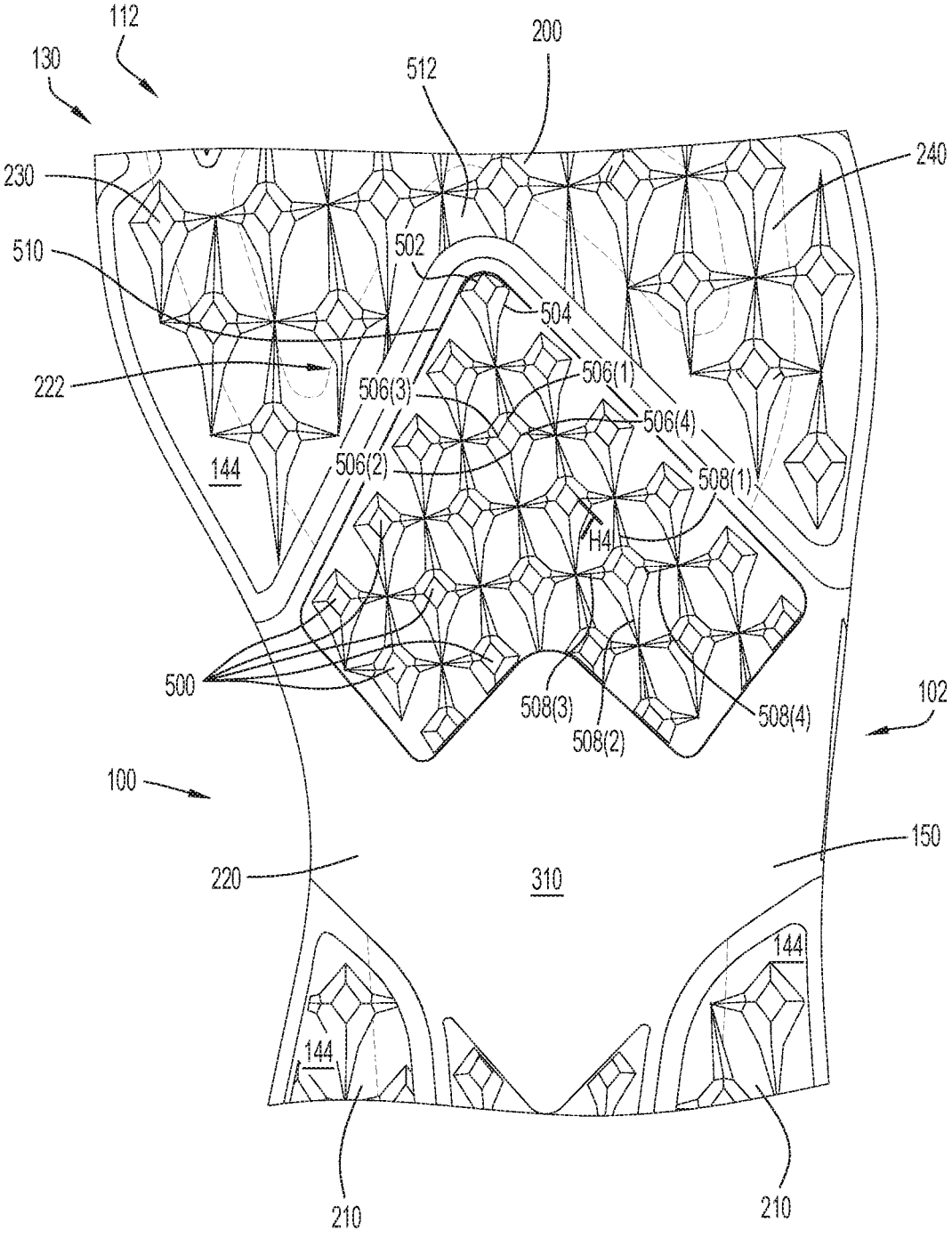
FIG. 5 illustrates a bottom view of the midfoot region of the forefoot region of the sole structure illustrated in FIG. 2.

As previously described herein, and as illustrated in FIG. 5, the midfoot section 220 of the second sole portion 150 may be primarily disposed in the midfoot region 112 of the sole structure 130 of the article of footwear 10, where the midfoot section 220 of the second sole portion 150 separates or divides the forefoot section 200 of the first sole portion 140 from the hindfoot section 210 of the first sole portion 140. While the midfoot section 220 of the second sole portion 150 is primarily disposed in the midfoot region 112, as previously described herein, the midfoot section 220 further includes a projection 222 that extends towards the toe end 104 from the midfoot section 220 into the forefoot region 110 of the sole structure 130. The projection 222 includes both an exposed portion 510 and a covered portion 512, where the covered portion 512 is covered by the bottom surface 144 of the forefoot section 200. As best illustrated in FIG. 5, the projection 222 is substantially triangular and the medial and lateral forward extensions 230, 240 extend forward from the covered portion 512 of the projection 222 of the midfoot section 220. In addition, a plurality of lugs 500 extend downwardly from the bottom surface 310 of the exposed portion 510 of the projection 222. As further illustrated in FIG. 5, the other portions of the midfoot section 220 do not include any lugs extending downwardly from the bottom surface 310. In addition, the bottom surface 310 of the exposed portion 510 of the midfoot section 220 may be aligned and level with the bottom surface 144 of the forefoot section 200 and the hindfoot section 210 of the first sole portion 140.

The lugs 500 of the midfoot section 220 are substantially similar in shape to the plurality of lugs 440 of the forefoot section 200 of the first sole portion 140. The lugs 500 extend downwardly from the bottom surface 310 of the projection 222 of the midfoot section 220. As illustrated in FIG. 5, the lugs 500 may be arranged or positioned in a grid-like array, where the lugs 500 are equally spaced from one another. In one embodiment, the lugs 500 are spaced closer together than the plurality of lugs 440 of the forefoot section 200. As best illustrated in FIG. 5, each of the lugs 500 may be in the form of a truncated cone or truncated pyramid. In other embodiments, however, the lugs 500 may be in the form of any other shape. The lugs 500 illustrated in FIG. 5 includes a top end 502 and a bottom end 504, where the bottom end 504 is coupled to the bottom surface 310 of the midfoot section 220 of the second sole portion 150. The top ends 502 of the lugs 500 may be configured to contact and impact a support surface, like that of the top ends 414, 434, 442 of lugs 412, 432, 440, respectively. Each of the lugs 500 may have a height H4, which is substantially similar to that of the height H2 of the first lugs 412 and the height H3 of the second lugs 432. The height H4 of the lugs 500 may be defined as the distance between the top end 502 and the bottom end 504, or as the distance the lugs 500 extend from the bottom surface 310 of the midfoot section 220 of the second sole portion 150. By having a height of H4, the lugs 500 are shorter than the plurality of lugs 440 of the forefoot section 200.

Furthermore, similar to the plurality of lugs 440, each of the lugs 500 includes a front or leading corner 506(1), a rear or trailing corner 506(2), a medial corner 506(3), and a lateral corner 506(4). Each of the lugs 500 also includes a series of flanges 508(1)-508(4) extending from each corner 506(1)-506(4) of the lugs 500. Thus, as illustrated, the front or leading flange 508(1) extends from the front or leading corner 506(1), the rear or trailing flange 508(2) extends from the rear or trailing corner 506(2), the medial flange 508(3) extends from the medial corner 506(3), and the lateral flange 508(4) extends from the lateral corner 506(4). The leading flange 508(1), medial flange 508(3), and lateral flange 508(4) may be coupled to the leading corner 506(1), medial corner 506(3), and lateral corner 506(4), respectively, at a location between the top end 502 and the bottom end 504 such that the leading flange 508(1), medial flange 508(3), and lateral flange 508(4) extend toward the bottom surface 310 in a manner that is substantially similar to that of the flanges 419(1), 439(1) of the first and second lugs 412, 432, respectively, and the flanges 448(1), 448(3), 448(4) of the plurality of lugs 440. The trailing flange 508(2) may be coupled to the trailing corner 506(2) at the top end 502 such that the trailing flange 508(2) extends downwardly towards the bottom surface 310 in a manner substantially similar to that of the trailing flanges 419(2), 439(2), 448(2) of the lugs 412, 432, 440, respectively. Furthermore, the trailing flange 508(2) of each of the lugs 500 may be longer in length than the other flanges 508(1), 805(3), and 508(4) of each of the lugs 500.

Figure 6A:
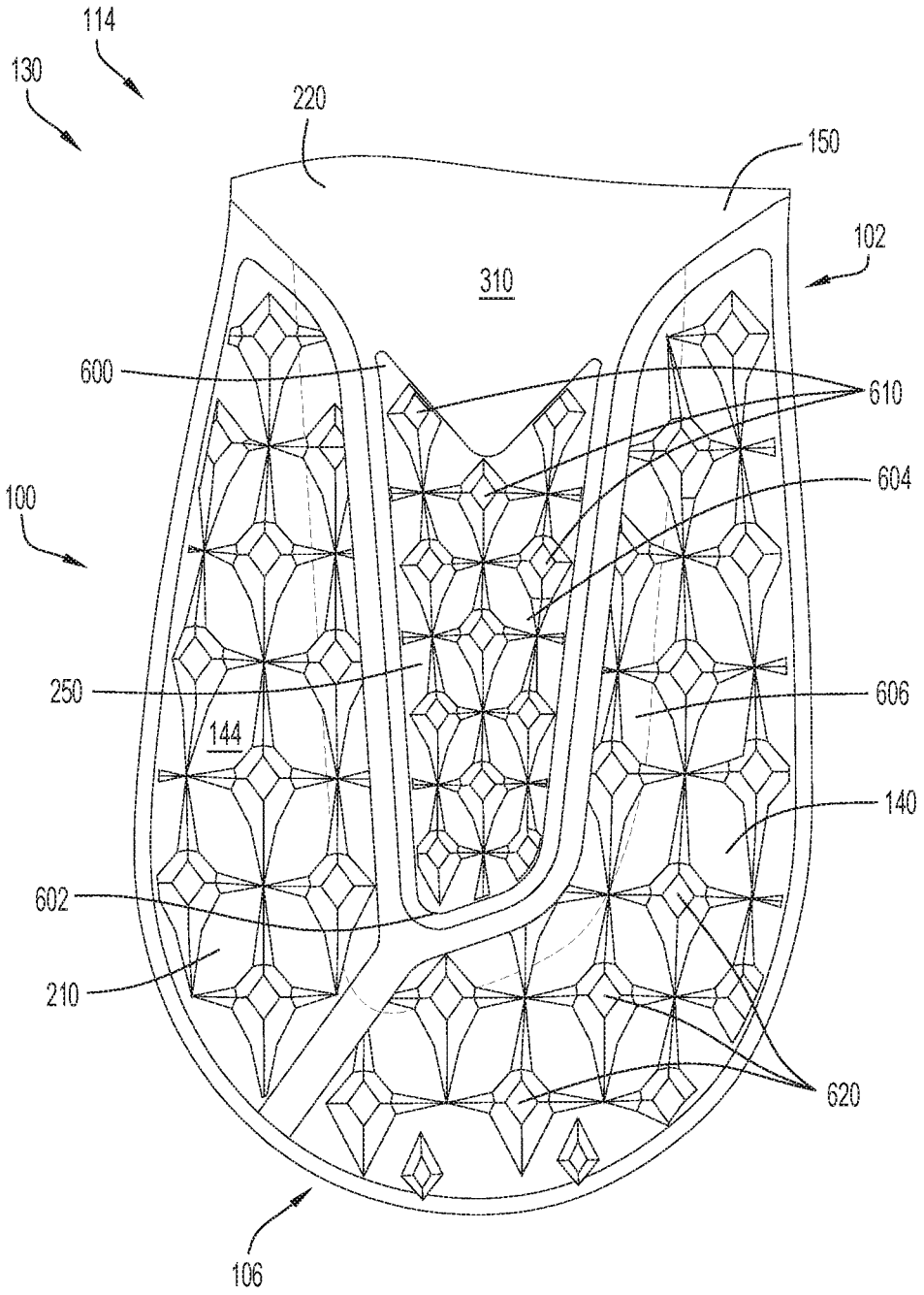
FIG. 6A illustrates a bottom view of the hindfoot region of the sole structure illustrated in FIG. 2.
Figure 6B:
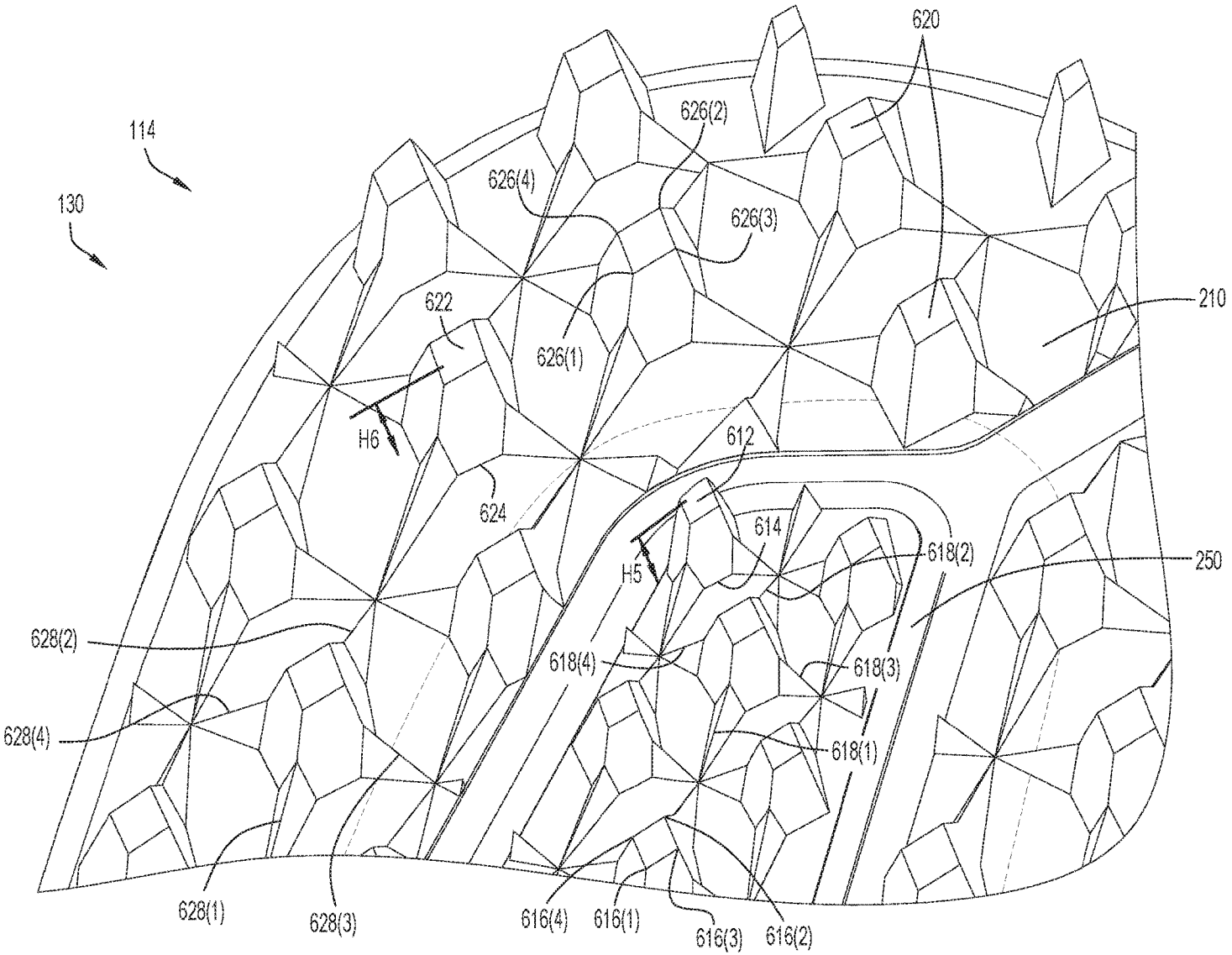
FIG. 6B illustrates a perspective view of a portion of the hindfoot region of the sole structure illustrated in FIG. 6B.

As previously described herein, the hindfoot region 114 of the sole structure 130 is constructed from the hindfoot section 210 of the first sole portion 140 and the rearward extension 250 of the second sole portion 150. As best illustrated in FIGS. 6A and 6B, the rearward extension 250 includes a proximal end 600 and a distal end 602, where the proximal end 600 is coupled to the midfoot section 220 of the second sole portion 150. The distal end 602 of the rearward extension 250 is disposed rearwardly from the midfoot section 220 and proximate to the heel end 106 of the sole structure 130. As best illustrated in FIG. 6A, the rearward extension 250 is centrally disposed, such that the rearward extension 250 is substantially equally spaced from the medial side 100 and the lateral side 102. The rearward extension 250 includes an exposed portion 604 and a covered portion 606. The covered portion 606 is disposed around the periphery of the rearward extension 250 and is covered by the bottom surface 144 of the hindfoot section 210 of the first sole portion 140. As illustrated in FIG. 6A, the hindfoot section 210 of the first sole portion 140 is disposed around the rearward extension 250 of the second sole portion 150, such that the hindfoot section 210 is substantially U-shaped. FIGS. 6A and 6B illustrate that a first plurality of lugs 610 extend downwardly from the bottom surface 310 of the rearward extension 250, while a second plurality of lugs 620 extend downwardly from the bottom surface 144 of the hindfoot section 210. The first plurality of lugs 610 of the rearward extension 250 are substantially similar in size, shape, and spacing to the plurality of lugs 500 of the midfoot section 220, while the second plurality of lugs 620 of the hindfoot section 210 are substantially similar in size, shape, and spacing to the plurality of lugs 440 of the forefoot section 200. In addition, the bottom surface 310 of the exposed portion 604 of the rearward extension 250 may be aligned and level with the bottom surface 144 of the hindfoot section 210 of the first sole portion 140.

As previously described herein, the first plurality of lugs 610 of the rearward extension 250 are substantially similar in size, shape, and spacing to the plurality of lugs 500 of the midfoot section 220. Similar to the lugs 500, the first plurality of lugs 610 extend downwardly from the bottom surface 310 of the rearward projection 250. As illustrated in FIGS. 6A and 6B, the lugs 610 may be arranged or positioned in a grid-like array, where the lugs 610 are equally spaced from one another. In the embodiment illustrated, the lugs 610 are spaced closer together than the second plurality of lugs 620 of the hindfoot section 210. As best illustrated in FIG. 6B, each of the lugs 610 may be in the form of a truncated cone or truncated pyramid, but in other embodiments, the lugs 610 may be in the form of any other shape. The lugs 610 illustrated in FIG. 6B includes a top end 612 and a bottom end 614, where the bottom end 614 is coupled to the bottom surface 310 of the rearward extension 250 of the second sole portion 150. The top ends 612 of the lugs 610 may be configured to contact and impact a support surface. Each of the lugs 610 may have a height H5, which is substantially similar to that of the height H2 of the first lugs 412, the height H3 of the second lugs 432, and the height H4 of the plurality of lugs 500. The height H5 of the lugs 610 may be defined as the distance between the top end 612 and the bottom end 614, or as the distance the lugs 610 extend from the bottom surface 310 of the rearward extension 250 of the second sole portion 150. Thus, the lugs 610 may be shorter in height than the lugs 440 of the forefoot section 200, which have a height H1 that is greater than heights H2, H3, H4, and H5.

Furthermore, similar to the plurality of lugs 500, each of the lugs 610 includes a front or leading corner 616(1), a rear or trailing corner 616(2), a medial corner 616(3), and a lateral corner 616(4). Each of the lugs 610 also includes a series of flanges 618(1)-618(4) extending from each corner 616(1)-616(4) of the lugs 610. Thus, as illustrated, the front or leading flange 618(1) extends from the front or leading corner 616(1), the rear or trailing flange 618(2) extends from the rear or trailing corner 616(2), the medial flange 618(3) extends from the medial corner 616(3), and the lateral flange 618(4) extends from the lateral corner 616(4). The leading flange 618(1), medial flange 618(3), and lateral flange 618(4) may be coupled to the leading corner 616(1), medial corner 616(3), and lateral corner 616(4), respectively, at a location between the top end 612 and the bottom end 614 such that the leading flange 618(1), medial flange 618(3), and lateral flange 618(4) extend toward the bottom surface 310 in a manner that is substantially similar to that of the flanges 419(1), 439(1) of the first and second lugs 412, 432, respectively, the flanges 448(1), 448(3), 448(4) of the plurality of lugs 440, and the flanges 508(1), 508(3), 508(4) of the plurality of lugs 500. The trailing flange 618(2) may be coupled to the trailing corner 616(2) at the top end 612 such that the trailing flange 618(2) extends towards the bottom surface 310 in a manner that is substantially similar to that of the trailing flanges 419(2), 439(2), 448(2), 508(2) of the lugs 412, 432, 440, 500, respectively. Furthermore, the trailing flange 618(2) of each of the lugs 610 may be longer in length than the other flanges 616(1), 616(3), and 616(4).

As previously described herein, the second plurality of lugs 620 of the hindfoot section 210 are substantially similar in size, shape, and spacing to the plurality of lugs 440 of the forefoot section 200. Similar to the lugs 440 of the forefoot section 200, the second plurality of lugs 620 extend downwardly from the bottom surface 144 of the hindfoot section 210 of the first sole portion 140. As illustrated in FIGS. 6A and 6B, the lugs 620 may be arranged or positioned in a grid-like array, where the lugs 620 are equally spaced from one another. In the embodiment illustrated, the lugs 620 are spaced farther away from each other compared to that of the first plurality of lugs 610 of the rearward extension 250. As best illustrated in FIG. 6B, and similar to each of the other lugs 412, 432, 440, 500, 610 of the sole structure 130, each of the lugs 620 may be in the form of a truncated cone or truncated pyramid. While illustrated in FIGS. 6A and 6B as truncated pyramids, other embodiments of the lugs 620 may be in the form of any other shape. The lugs 620 illustrated in FIG. 6B includes a top end 622 and a bottom end 624, where the bottom end 624 is coupled to the bottom surface 144 of the hindfoot section 210 of the first sole portion 140. The top ends 622 of the lugs 620 may be configured to contact and impact a support surface. Each of the lugs 620 may have a height H6, which is substantially similar to the height H1 of the plurality of lugs 440 on the forefoot section 200. The height H6 of the lugs 620 may be defined as the distance between the top end 622 and the bottom end 624, or as the distance the lugs 620 extend from the bottom surface 144 of the hindfoot section 210 of the first sole portion 140. Thus, the lugs 620 may be taller than the lugs 610 of the rearward extension 250, the lugs 500 of the midfoot section 220, and the lugs 412, 432 of the forward extensions 230, 240, respectively.

Furthermore, similar to the plurality of lugs 440, each of the lugs 620 includes a front or leading corner 626(1), a rear or trailing corner 626(2), a medial corner 626(3), and a lateral corner 626(4). Each of the lugs 620 also includes a series of flanges 628(1)-628(4) extending from each corner 626(1)-626(4) of the lugs 620. Thus, as illustrated, the front or leading flange 628(1) extends from the front or leading corner 626(1), the rear or trailing flange 628(2) extends from the rear or trailing corner 626(2), the medial flange 628(3) extends from the medial corner 626(3), and the lateral flange 628(4) extends from the lateral corner 626(4). The leading flange 628(1), medial flange 628(3), and lateral flange 628(4) may be coupled to the leading corner 626(1), medial corner 626(3), and lateral corner 626(4), respectively, at a location between the top end 622 and the bottom end 624 such that the leading flange 628(1), medial flange 628(3), and lateral flange 628(4) extend toward the bottom surface 144 in a manner that is substantially similar to that of the flanges 419(1), 439(1) of the first and second lugs 412, 432, respectively, the flanges 448(1), 448(3), 448(4) of the plurality of lugs 440, the flanges 508(1), 508(3), 508(4) of the plurality of lugs 500, and the flanges 618(1), 618(3), 618(4) of the plurality of lugs 610. The trailing flange 628(2) may be coupled to the trailing corner 626(2) at the top end 622 such that the trailing flange 628(2) extends towards the bottom surface 144 in a manner that is substantially similar to that of the trailing flanges 419(2), 439(2), 448(2), 508(2), 618(2) of the lugs 412, 432, 440, 500, 610 respectively. Furthermore, the trailing flange 628(2) of each of the lugs 620 may be longer in length than the other flanges 626(1), 626(3), and 626(4).

Figure 7A:
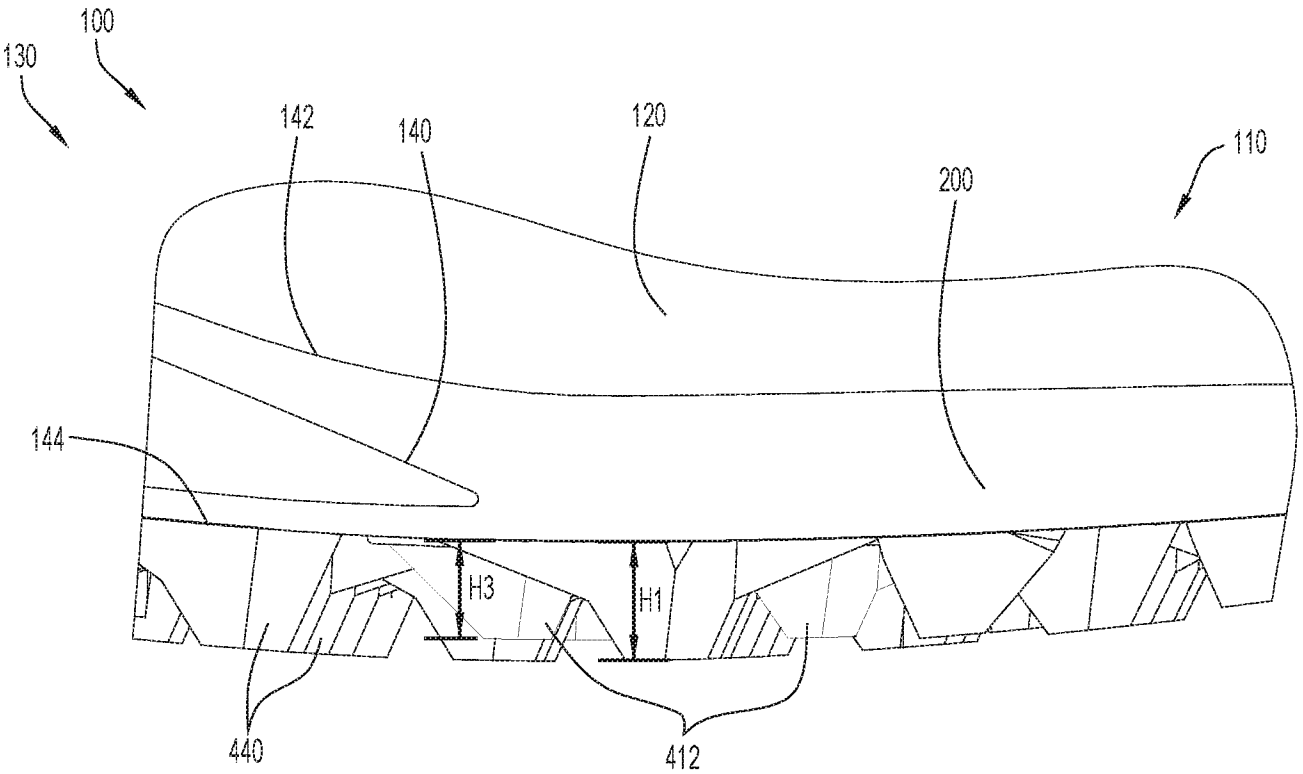
FIG. 7A illustrates a side elevational view of the forefoot region of the sole structure illustrated in FIG. 4A.
Figure 7B:
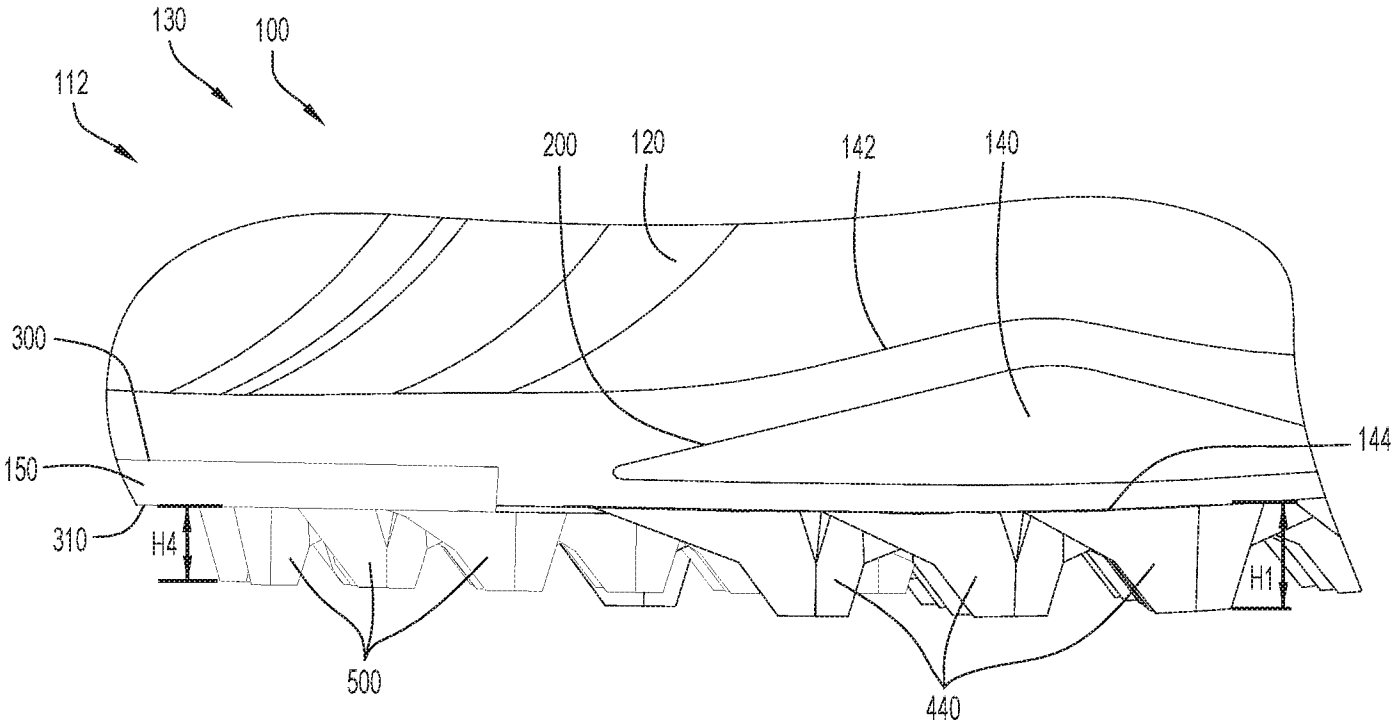
FIG. 7B illustrates a side elevational view of the midfoot region of the sole structure illustrated in FIG. 5.
Figure 7C:
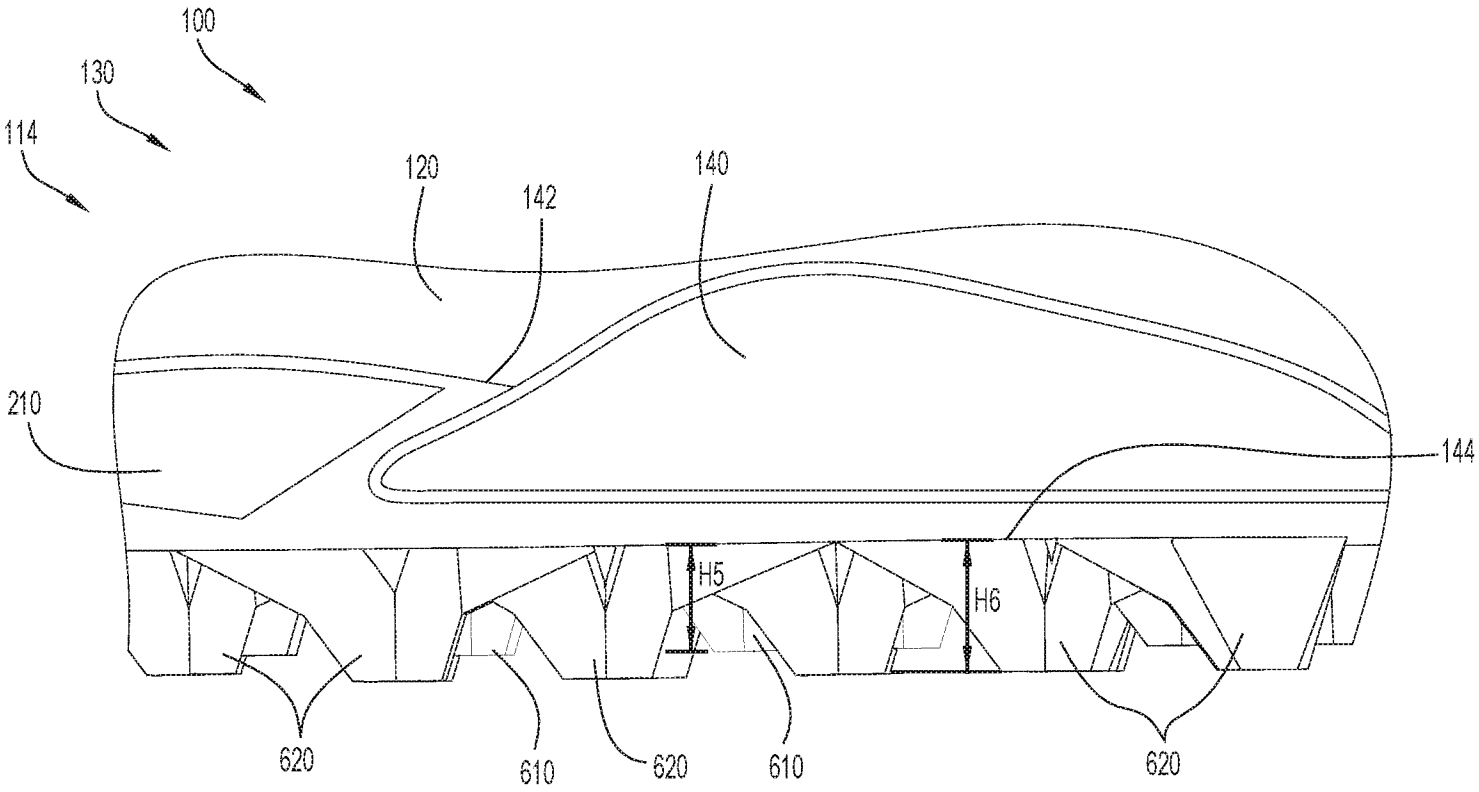
FIG. 7C illustrates a side elevational view of the hindfoot region of the sole structure illustrated in FIG. 6A.

As previously described herein, and as best illustrated in FIGS. 7A, 7B, and 7C, the lugs 440 and 620 of the forefoot and hindfoot sections 200, 210, respectively, extend from the bottom surface 144 of the first sole portion 140 a distance H1, H5, respectively. Furthermore, the lugs 412, 432, 500, and 610 of the various sections of the second sole portion 150 extend a distance H2, H3, H4, H5, respectively, beyond the bottom surface 144 of the first sole portion 140. In addition, as described herein previously, the distances of H1 and H6 are greater than the distances of H2, H3, H4, and H5. Thus, as best illustrated in FIG. 7A, the lugs 440 of the forefoot section 200 extend farther from the bottom surface 144 of the first sole portion 140 than the first lugs 412 of the medial forward extension 230. While not illustrated, because the second lugs 432 of the lateral forward extension 240 are substantially similar to the first lugs the first lugs 412 of the medial forward extension 230, the plurality of lugs 440 of the forefoot section 200 also extend farther from the bottom surface 144 of the first sole portion 140 than the second lugs 432 of the lateral forward extension 240. As best illustrated in FIG. 7B, the lugs 440 of the forefoot section 200 extend farther from the bottom surface 144 of the first sole portion 140 than the plurality of lugs 500 of the midfoot section 220. Furthermore, as best illustrated in FIG. 7C, the lugs 620 of the hindfoot section 210 extend farther from the bottom surface 144 of the first sole portion 140 than the lugs 610 of the rearward extension 250 of the second sole portion 150.

Figure 7D:
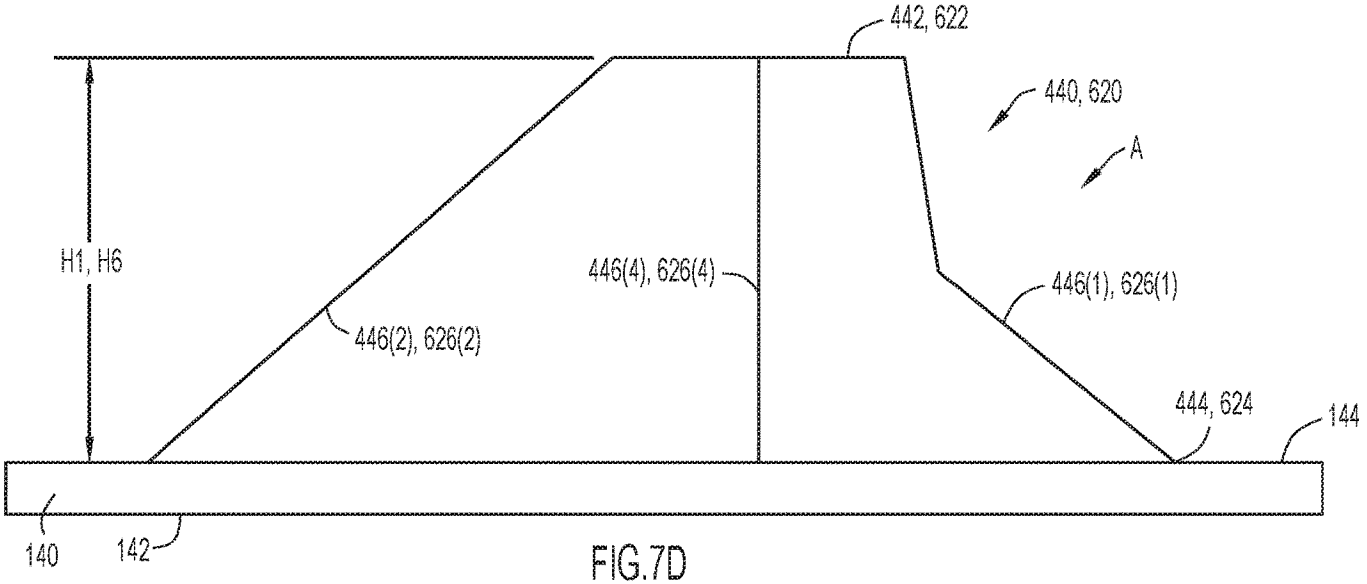
FIG. 7D illustrates a side elevational view of a schematic drawing of the lugs of the forefoot and hindfoot sections illustrated in FIGS. 4A and 6B, where the lug is in an uncompressed configuration.
Figure 7E:
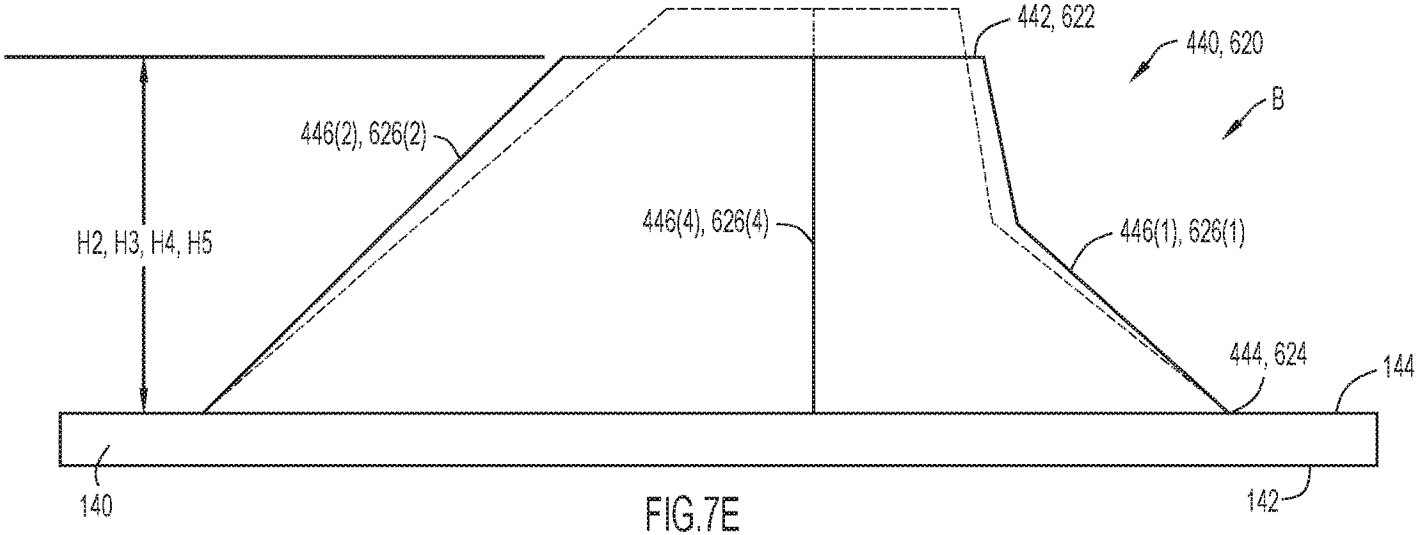
FIG. 7E illustrates a side elevational view of a schematic drawing of the lugs of the forefoot and hindfoot sections illustrated in FIGS. 4A and 6B, where the lug is in a compressed configuration.

Because the plurality of lugs 440 of the forefoot section 200 and the plurality of lugs 620 of the hindfoot section 210 are formed as part of the first outsole 140, which is constructed from a TPU with a soft durometer, the lugs 440, 620 are compressible, like that illustrated in FIGS. 7D and 7E. When in the uncompressed configuration A (FIG. 7D), the length of the lugs 440, 620 (i.e., the distance between the bottom ends 444, 624 and the top ends 442, 622, respectively) is approximately H1, H6, respectively. In one embodiment, the lugs 440, 620, when in the uncompressed configuration A, may have a height H1, H6 of approximately 8.0 mm. When the article of footwear 10 is pressed into the support surface (i.e., when a person wearing the article of footwear 10 is standing on a support surface or when their foot impacts a support surface), the soft TPU material of the first outsole 150 promotes compression of the lugs 440, 620, where the lugs 440, 620 compress from the uncompressed configuration A (FIG. 7D) to the compressed configuration B (FIG. 7E). When the lugs 440, 620 are compressed, the height of the lugs 440, 620 shortens from uncompressed height H1, H6 to a compressed height equal to that of heights H2, H3, H4, and H5. The compressed height may be equivalent to the heights H2, H3 of the first and second lugs 412, 432 of the forward extensions 230, 240, respectively, the height H4 of the lugs 500 of the midfoot section 220, and the height H5 of the lugs 610 of the rearward extension 250. In one embodiment, normal compression (i.e., a person wearing the article of footwear 10 forcing the forcing into a support surface by placing their weight on the article of footwear 10 or by impacting their foot with the support surface) of the lugs 440, 620 may compress the lugs from an uncompressed height H1, H6 of 8.0 mm to the compressed height of approximately 7.0 mm. Thus, the first and second lugs 412, 432 of the forward extensions 230, 240, respectively, the lugs 500 of the midfoot section 220, and the lugs 610 of the rearward extension 250 may also have the height H2, H3, H4, H5, respectively, of 7.0 mm. Thus, as the lugs 440, 620 are compressed from the uncompressed configuration A to the compressed configuration B, the top ends 442, 622 become aligned with the top ends 414, 434, 502, 612 of the lugs 412, 432, 500, 610, respectively. Other embodiments of the lugs 412, 432, 440, 500, 610, 620 may have different values for the heights H1, H2, H3, H4, H5, H6 but the difference between larger heights H1, H6 and smaller heights H2, H3, H4, H5 may remain approximately 1.0 mm.

While the lugs 440, 620 of the first sole portion 140 are compressible and constructed from a TPU with a soft durometer, the lugs 412 of the medial forward extension 230, the lugs 432 of the lateral forward extensions 240, lugs 500 of the midfoot section 220, and lugs 610 of the rearward extension 250 are constructed from a TPU with a hard durometer. Thus, the lugs 412 of the medial forward extension 230, the lugs 432 of the lateral forward extensions 240, lugs 500 of the midfoot section 220, and lugs 610 of the rearward extension 250 are not compressible.

By forming the sole structure 130 of the article of footwear 10 with dual durometer sole portions 140, 150, the traction of the article of footwear 10 is improved for the forces typically experienced by the article of footwear 10. As previously described herein, the softer durometer of lugs 440, 620 of the first sole portion 140 enables the lugs 440, 620 to compress both when the lugs 440, 620 impact a support surface and when a person places their weight on the sole structure 130. When no force or a minimal force is applied to the lugs 440, 620, the lugs 440, 620 are uncompressed and extend farther from the bottom surface 144 of the first sole portion 140 than the lugs 412, 432, 500, 610 of the second sole portion 150. When compressed by enough force, however, the lugs 440, 620 of the first sole portion 140 may extend from the bottom surface 144 of the first sole portion 140 the same distance as the lugs 412, 432, 500, 610 of the second sole portion 150. Thus, the compressible properties of the lugs 440, 620 permit compression of the lugs 440, 620 until the ends 414, 434, 442, 502, 612, 622 of the lugs 412, 432, 440, 500, 610, 620, respectively, are all disposed within the same plane. Thus, when the sole structure 130 is supporting a user's weight on a support surface, the ends 414, 434, 442, 502, 612, 622 of the lugs 412, 432, 440, 500, 610, 620, respectively, may all be in contact with the support surface.

Furthermore, the greater height of the lugs 440, 620 of the first sole portion enables the ends 442, 622 of the lugs 440, 620 to typically impact or contact the support surface prior to the ends 414, 434, 502, 612 of the lugs 412, 432, 500, 610, respectively. This enables the compressible lugs 440, 620 to provide an additional amount of cushion to the foot of the wearer of the article of footwear 10 when the article of footwear 10 initially impacts the support surface (e.g., when walking, running, jumping, etc.).

As illustrated in FIGS. 7D and 7E, the compressibility of the lugs 440, 620 also widens, or spreads, the ends 442, 622 of the lugs 440, 620. In addition, the compressible nature of the lugs 440, 620 may also enable the lugs 440, 620 to bend/move side to side. This compressibility and movement of the lugs 440, 620 promotes better traction of the article of footwear 10 by keeping the bottom surface 144 of the first sole portion 140 in contact with the ground for the longest amount of time (e.g., during various phases of a typical gait, shifting the weight of the user to different portions of the foot, etc.), even after the ends 414, 434, 502, 612 of the lugs 412, 432, 500, 610, respectively, are no longer in contact with the support surface. For example, as a person shifts their weight on their foot from side to side or from back to front, the compressibility and bendability of the lugs 440, 620 may keep the ends 442, 622 of the lugs 440, 620, respectively, in contact with the support surface. In addition, the compressibility and bendability of the lugs 440, 620 may enable more of the ends 442, 622 of the lugs 440, 620, respectively, to remain in contact with an uneven support surface (i.e., some of the lugs 440, 620 being more compressed than others). The soft durometer TPU of the lugs 440, 620 further increases the amount of friction created between the support surface, especially when the support surface is a turf field (e.g., support surface constructed of a backing layer, a plurality of fibers extending upwardly from the backing layer, and an infill material disposed between the plurality of fibers) and the lugs 440, 620. The increased friction created between the lugs 440, 620 and the fibers and infill of the turf field enables a person utilizing the article of footwear 10 to more efficiently make movements (e.g., jumping, running, jogging, cutting to change directions, etc.). The ends 442, 622 of the lugs 440, 620 create a first level of traction through the created friction, while the flanges 448(1)-448(4), 628(1)-628(4) create a secondary level of traction with the support surface. As the ends 442, 622 of the lugs 440, 620 are pressed into the support surface, whether the support surface is a natural surface or artificial surface (e.g., turf field, concrete, etc.), the flanges 448(1)-448(4), 628(1)-628(4) may also contact the support surface. The stronger the force that compresses the lugs 440, 620, the larger the portion of the flanges 448(1)-448(4), 628(1)-628(4) of the lugs 440, 620, respectively, that contact the support surface. Especially when used on a turf field, the flanges 448(1)-448(4), 628(1)-628(4) of the lugs 440, 620, respectively, may be pressed into the infill of the turf field to further provide additional traction. It then follows that as the compression of the lugs 440, 620 is increased, the friction between the lugs 440, 620 and the support surface increases, and the article of footwear 10 is further configured to provide more traction to the user wearing the article of footwear 10.

As previously described herein, and as best illustrated in FIG. 4A, the medial and lateral forward extensions 230, 240 extend forward through the forefoot region 110 from the midfoot section 220 above the bottom surface 144 of the forefoot section 200 of the first sole portion 140. The medial forward extension 230 extends along the medial side 100 of the forefoot region 110, while the lateral forward extension 240 extends along the lateral side 102 of the forefoot region 110. Because the medial and forward extensions 230, 240 form part of the second sole portion 150, the medial and forward extensions 230, 240 are constructed from a harder, non-compressible or incompressible TPU material when compared to that of the TPU material used to construct the first sole portion 140. While the medial and forward extensions 230, 240 are incompressible, the medial and forward extensions 230, 240 may be thinner than other portions of the second sole portion 140, and thus, are capable of bending or flexing with the article of footwear 10. More specifically, as a person wearing the article of footwear 10 performs movements and motions (e.g., running, jumping, cutting, jogging, etc.), the article of footwear 10 bends in the forefoot region 110 proximate to the metatarsal and flanges of the foot placed within the article of footwear 10. When the article of footwear 10 bends in the forefoot region 110 (e.g., the toe end 104 of the article of footwear 10 bends backward over the upper 120), the medial and forward extensions 230, 240 also bend. The properties of the TPU material of the medial and forward extensions 230, 240 cause the medial and forward extensions 230, 240 to act as springs or resilient members that resiliently return to their unbent state when the force causing the article of footwear 10 to bend is reduced or removed. Thus, the medial and forward extensions 230, 240 provide a spring back effect to the forefoot region 110 of the article of footwear 10, where the medial and forward extensions 230, 240 enable the article of footwear 10, and ultimately the foot, to spring off of the support surface during a toe-off phase of a gait (e.g., walking, running, jogging, etc.). In addition, the medial and forward extensions 230, 240 enable the article of footwear 10 to spring off of the support surface when the user of the article of footwear 10 performs cutting motions, which results in the user completing their cutting motions quicker.

The lugs 500, 610 of the midfoot section 220 and the rearward extension 250, respectively, add additional traction to the article of footwear 10 when performing movements with the article of footwear 10. As described herein previously, the lugs 500 of the midfoot section 220 are disposed on the bottom surface 310 of the projection 222 that is disposed proximate to the transition of the forefoot region 110 to the midfoot region 112. Thus, the lugs 500 are disposed proximate to the ball of the foot disposed within the article of footwear 10 or just rearward of the ball of the foot disposed within the article of footwear 10. When performing movements (e.g., running, walking, etc.) most of the weight of a user is placed on the balls of the feet of the user. By positioning the non-compressible or incompressible lugs in the region of the article of footwear 10 that is proximate to the ball of the foot placed within the article of footwear 10, the lugs 500 are more likely to be driven into the support surface when performing movements, especially if the softer, more compressible lugs 440 of the forefoot section 200 are not capable of being driven into the support surface. In addition, weight is also often placed on the heel or calcaneus bone of feet, especially when performing athletic movements (e.g., cutting motions when running, backpedaling, etc.). As previously described herein, the rearward extension 250 extends through the hindfoot region 114 of the sole structure 130 such that the rearward extension 250 aligned with the heel or calcaneus bone of the foot placed within the article of footwear 10. Thus, when the weight of the user wearing the article of footwear 10 is placed on the heel of the foot placed within the article of footwear, the lugs 610 of the rearward extension 250 are more likely to be driven into the support surface, especially if the softer, more compressible lugs 620 of the hindfoot section 210 are not capable of being driven into the ground. In addition, by being constructed from a harder, non-compressible TPU material, the lugs 500, 610 are less likely to wear and deteriorate during use of the article of footwear 10 than the softer, more compressible lugs 440, 620.

Additionally, the midfoot section 220 and the rearward extension 250 form a plate-like structure under the foot placed within the article of footwear 10. The plate formed by the midfoot section 220 and the rearward extensions 250 provides added stability to the sole structure 130, which helps to support the foot disposed within the article of footwear 10. This additional support is useful when the user performs cutting motions, where the foot disposed within the article of footwear 10 may experience extreme forces and where the article of footwear 10 may impact the support surface in abnormal or uncommon manners.

The dual durometer sole structure 130 of the first sole portion 140 and the second sole portion 150 may be constructed by a double-shot process. The first and second sole portions 140, 150 may be molded from a mold comprising a primary mold portion and a secondary mold portion. The first sole portion 140 may be formed by the primary mold portion while the second sole portion 150 may be formed by the secondary mold portion. As previously described herein, the second sole portion 150 may be formed of a material having a hard durometer value, while the first sole portion 140 may be formed of a material having a soft durometer value. The first sole portion 140 may be molded around/over the second sole portion 150 while leaving exposed the midfoot section 220, the medial and lateral exposed portions 410, 430, and the rearward extensions 250.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An article of footwear comprising:

an upper defining a cavity;

a first sole structure having a bottom surface and an opposite top surface, the top surface being directly coupled to the upper, the first sole structure having a first durometer value and comprising a forefoot section, a hindfoot section, and a plurality of first lugs disposed on the bottom surface of the forefoot section and the hindfoot section; and a second sole structure disposed between the forefoot section and the hindfoot section of the first sole structure and extending from an outermost lateral edge of the article of footwear to an outermost medial edge of the article of footwear, the second sole structure having a second durometer value that is greater than the first durometer value, the second sole structure comprising a plurality of second lugs extending from the second sole structure beyond the bottom surface of the first sole structure.

2. The article of footwear of claim 1, wherein the plurality of first lugs extend beyond the bottom surface of the first sole structure a first distance, and the plurality of second lugs extend beyond the bottom surface of the first sole structure a second distance, the first distance being greater than the second distance.

3. The article of footwear of claim 2, wherein the plurality of first lugs and the plurality of second lugs are truncated pyramids having a leading corner, a trailing corner, a medial corner, and a lateral corner.

4. The article of footwear of claim 3, wherein the plurality of first lugs further comprise:

a leading flange extending from the leading corner;

a trailing flange extending from the trailing corner;

a medial flange extending from the medial corner; and a lateral flange extending from the lateral corner, wherein the leading, trailing, medial, and lateral flanges increase traction of the article of footwear on an artificial turf surface.

5. The article of footwear of claim 2, wherein the first durometer value of the first sole structure enables the plurality of first lugs of the first sole structure to be compressed from an uncompressed configuration, where the plurality of first lugs extend the first distance from the bottom surface of the first sole structure, to a compressed configuration, where the plurality of first lugs extend the second distance from the bottom surface of the first sole structure.

* * * * *